US009867745B2

(12) United States Patent
Krolick et al.

(10) Patent No.: US 9,867,745 B2
(45) **Date of Patent: *Jan. 16, 2018**

(54) EMERGENCY LIFT AND TRANSPORT SYSTEM

(71) Applicants: Robert S Krolick, Roseville, CA (US); Sanford Shapiro, San Rafael, CA (US); Duane Carling, Farmington, UT (US)

(72) Inventors: Robert S Krolick, Roseville, CA (US); Sanford Shapiro, San Rafael, CA (US); Duane Carling, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/442,967

(22) Filed: Feb. 27, 2017

(65) Prior Publication Data

US 2017/0196740 A1 Jul. 13, 2017

Related U.S. Application Data

(63) Continuation-in-part of application No. 14/741,299, filed on Jun. 16, 2015, now Pat. No. 9,579,240.

(51) Int. Cl.

| | |
|---|---|
| ***A61G 1/04*** | (2006.01) |
| ***A61G 1/013*** | (2006.01) |
| ***A61G 1/056*** | (2006.01) |
| ***A61G 7/12*** | (2006.01) |
| ***A61G 7/012*** | (2006.01) |

(52) U.S. Cl.

CPC ..... *A61G 1/04* (2013.01); *A61G 1/013* (2013.01); *A61G 1/056* (2013.01); *A61G 7/012* (2013.01)

(58) Field of Classification Search

CPC .... A47C 19/045; A61G 1/013; A61G 1/0212; A61G 1/0565; A61G 7/012; A61G 13/06; A61G 1/003; A61G 1/04; A61G 1/06; B66F 3/28; B66F 5/04; B66F 7/08

See application file for complete search history.

(56) References Cited

U.S. PATENT DOCUMENTS

| | | | | |
|---|---|---|---|---|
| 2,202,383 A | | 12/1937 | Hymer et al. | |
| 3,901,356 A | * | 8/1975 | Butler | B66F 7/065 187/211 |
| 4,273,306 A | * | 6/1981 | Chang | A47B 9/16 108/145 |
| 4,549,720 A | * | 10/1985 | Bergenwall | A47B 9/16 187/269 |
| 4,987,620 A | | 1/1991 | Sharon | |

(Continued)

*Primary Examiner* — Nicholas F Polito
(74) *Attorney, Agent, or Firm* — Steven A. Nielsen; www.NielsenPatents.com

(57) ABSTRACT

A lift system 100 may comprise two sets of two pistons with each set of pistons attached to an upper cross bar 210 and a lower cross bar 275, with the lower cross bar having distal ends comprising distal insertion areas 276 with the distal insertion areas passing through a first void 241 defined within a wheelie bar 240 and the distal insertion areas 276 reaching further to move a wedge bar 270. To lift a patient from a lowered position, a piston moves a lower cross bar 275 which in turn moves a wedge bar 270 into a wedge 280, causing the lower cross bar to break out of plane with a top bar 205. The use of two wheelie gears 220 ensures that the lift remains horizontal even if piston forces are not uniform. The use of four top bars 205 allows for folded storage.

9 Claims, 34 Drawing Sheets

(56) References Cited

U.S. PATENT DOCUMENTS

| | | | | |
|---|---|---|---|---|
| 6,336,235 | B1 | 1/2002 | Ruehl | |
| 6,381,781 | B1 | 5/2002 | Bourgraf et al. | |
| 6,389,623 | B1 | 5/2002 | Flynn et al. | |
| 6,799,770 | B2 | 10/2004 | Patrick et al. | |
| 7,013,510 | B1 * | 3/2006 | Johnson | A61G 1/0562 296/20 |
| 9,107,781 | B1 * | 8/2015 | Edgerton | A61G 7/012 |
| 9,351,584 | B1 * | 5/2016 | Rizzardo | A47C 19/045 |
| 9,579,240 | B2 * | 2/2017 | Krolick | A61G 1/017 |
| 2006/0016008 | A1 * | 1/2006 | Choi | A61G 1/0562 5/611 |
| 2015/0359693 | A1 * | 12/2015 | Lyon | A61G 7/015 5/610 |

* cited by examiner

EMERGENCY LIFT AND TRANSPORT SYSTEM

RELATED PATENT APPLICATION AND INCORPORATION BY REFERENCE

This utility patent application is a continuation-in-part of U.S. patent application Ser. No. 14/741,299 filed on Jun. 16, 2015. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to low profile stretchers that rise in a horizontal position. More particularly, the invention relates to the use of unique rotational and sliding components that are inwardly layered to create a low profile lift that moves a patient from the floor to a raised position without human effort in the lifting. Disclosed embodiments feature folding top portions, allowing the lift to be compactly stored in a vertical position.

(2) Description of the Related Art

In the related art, health care workers and first responders face the dilemma of moving a patient from the ground to a raised position. Such workers often suffer significant injuries in manually lifting a patient off of the ground. A traditional folding cot stretcher having a wood frame and cloth body provides a low profile platform wherein a patient may be rolled or slid upon the cloth body or patient surface. The wood and cloth stretcher is then lifted off of the ground by workers. While sliding or rolling a patient upon a low profile prior art cot stretcher presents a minimal risk of injury, manually lifting the stretcher presents a significant risk of injury.

In the related art, stretchers with mechanical means of lift are known, but present a raised profile, inviting injury to workers lifting a patient upon the raised platform. For example, U.S. Pat. No. 6,389,623 issued on May 21, 2002 to Flynn et al presents a modern iteration of the classical ambulance stretcher and discloses a flat stretcher near the ground and provides a scissor type frame to lift the stretcher off of the ground. FIG. 12 of Flynn presents a profile view of the stretcher in its lowest position and shows several components, vertically configured, between the patient surface and the ground. The existence of components between the patient surface and the ground represents a vertical distance requiring the manual lifting of a patient.

European patent application 90830259.9, publication No. EP 0 406 178 A2 by Corradi discloses a wheeled stretcher used to move a patient from a bed to a stretcher and vice versa. The Corradi stretcher relies upon a standing frame to keep the structure at a bed level and is not designed to lift a patient from the ground. While the Corradi stretcher will move a patient from bed to bed, Corradi fails to lift a patient from the ground.

The related art fails to disclose or suggest means or methods of providing a stretcher having a patient surface at near ground level and means of mechanically lifting the patient to a raised position. Health care workers currently injure themselves lifting up prior art wood and cloth stretchers or from lifting patients upon the raised platforms of prior art mechanical lifts. Thus, there are significant shortfalls in the prior art.

BRIEF SUMMARY OF THE INVENTION

The present invention overcomes shortfalls in the related art by presenting an unobvious and unique combination, configuration and use of components to present a low profile stretcher having mechanical means of lifting a patient in a horizontal position. Disclosed embodiments overcome shortfalls in the art by providing a unique set of components that are horizontally layered so as to present an initial low profile from the ground and efficient means of mechanical lift. The presently disclosed embodiments provide the low profile of a wood and cloth cot stretcher but with mechanical means of lifting a patient, thus greatly reducing the risk of injury to health care workers.

Disclosed embodiments overcome shortfalls in the art with an efficient configuration of an integrated piston design, and in the disclosed embodiments, using four pistons. Mechanical lift may be achieved by use of integrated pistons that may be powered by any means such as hydraulics, hand or foot pumps, $CO_2$ cartridges, pulleys and hand cranks. The integrated piston system achieves a low profile and mechanical efficiency by attachment to an upper cross bar and attachment to a lower cross bar, with the lower cross bar moving within a first track or void of a wheelie bar, with the lower cross bar further penetrating the wheelie bar and moving a wedge bar. The wedge bar may be initially positioned to the inside of a top bar, with the top bar attached to a wedge. Starting in a flat position, as the piston is moved, the lower cross bar moves within a wheelie bar and moves the wedge bar into the wedge, causing an initial lifting movement.

The initial movement of the wedge bar into the wedge starts the initial vertical movement of the wheelie bar. The first longitudinal void of the wheelie bar not only retains the powered lower cross bar but also assists in transferring movement of the piston to angular movement of the wheelie bar.

Disclosed embodiments overcome the related art by presenting a four piston system that allows each piston system to be smaller than other systems and allows for less pressure needed per piston. The use of smaller pistons is conducive to achieve a low profile and low weight such that the system may be stored flat upon a wall, ready for use.

Disclosed embodiments overcome shortfalls in the art by the use of a wheelie gear that integrates with a wheelie bar and a center hinge assembly. The use of two top bars, used to secure two wheelie gears overcomes shortfalls in the art by the geared movement of two sets of wheelie bars. Thus, the disclosed lifts move upwardly and downwardly in a uniform and level manner. The use of two wheelie gears ensures that uneven piston movement does not skew, rack or otherwise degrade system performance. Geared attachment between the two wheelie gears keeps both sides of the lift level at all times.

Disclosed embodiments overcome shortfalls in the art by the artful use and integration of halved top bars, which allow the top portions of a lift to fold downwardly to comport with the folded lower half. This configuration allows for convenient storage in a vertical position such that a user does not need to lift the product off of a rack, as the lift may be stored upon the ground, wherein a user may roll the lift to the desired location and then lower the lift to assist a patient.

The disclosed embodiments overcome shortfalls in the art by providing increased speed in operation wherein mechanical advantages are used to quickly raise and lower a lift.

These and other advantages over the prior art will become even more apparent after consideration of the drawings and more detailed description.

REFERENCE NUMERALS IN THE DRAWINGS

Figure 1A:
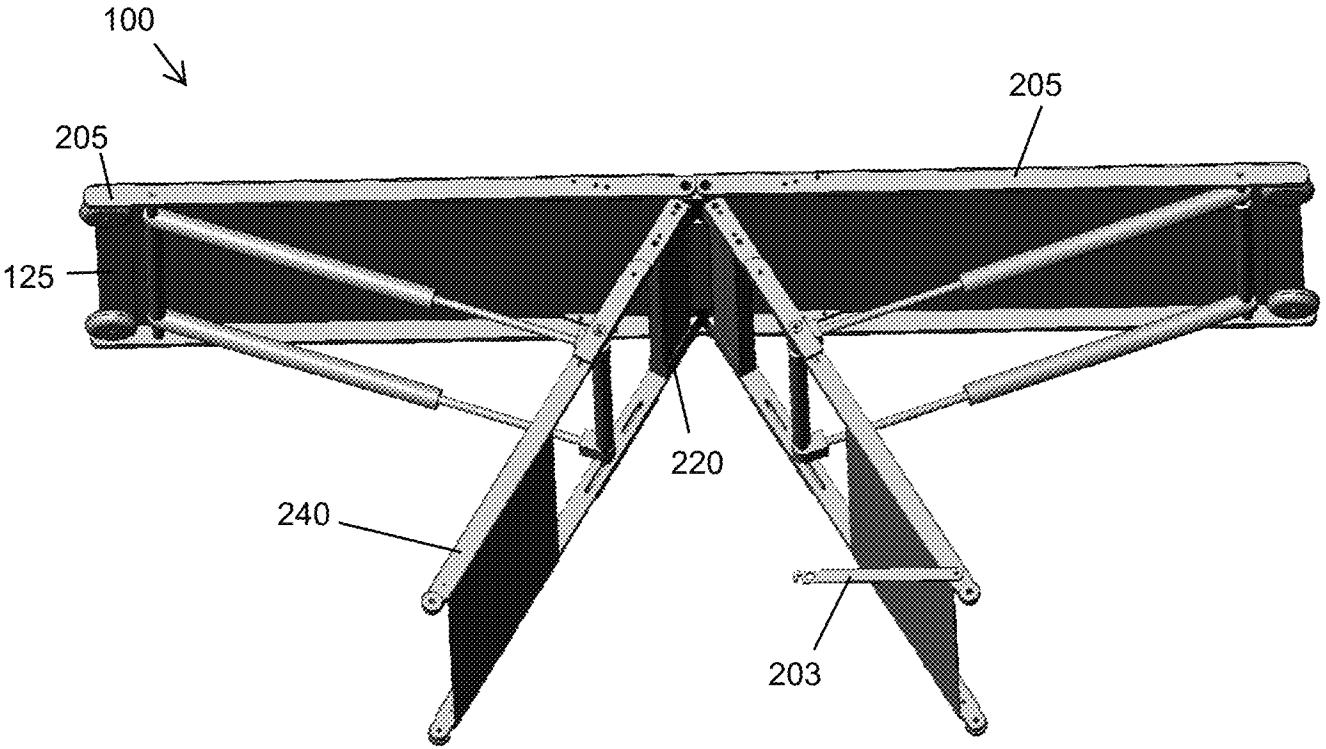
FIG. 1A is a perspective view of a lift system

100 lift in general
125 back board
203 leg latch
205 top bar
206 center voids defined within center section of top bar, may be used to retain wheelie gear and/or center assembly 280
210 cylinder rod cross head or upper cross bar, may be of same or similar construction as cross bar or lower cross bar 275
212 distal end of upper cross bar 210
220 wheelie gear
221 cross bar of wheelie gear 220
224 side bar of wheelie gear 220
227 gear teeth of wheelie gear
228 horizontal walls of gear teeth
229 pivot void of wheelie gear 220
239 optional wheel sometimes found at end of wheelie bar
240 wheelie bar
241 first longitudinal void of wheelie bar 240, may retain cross bar 275
242 pivot attachment voids of wheelie bar 240
243 second longitudinal void of wheelie bar 240, may retain cambered side of wedge bar 270
245 body or longitudinal body of wheelie bar 240
260 cylinder
265 piston
267 cylinder rod clevis
269 second void of wedge bar, sometimes used to retain pin inserted into a second void of a wheelie bar
270 wedge bar
271 cambered edge of wedge bar 270 used with angled edge 281 of wedge 280
272 indent area of wedge bar, used to retain wedge washer
273 void of wedge bar
274 longitudinal body of wedge bar 270
275 cross bar or lower cross bar
276 distal insertion area, used to mate with void of wheelie bar and to attach to wedge bar
278 main longitudinal section of cross bar 275
279 retention area of cross bar 275, may be used to retain a cylinder rod clevis 267
280 wedge
281 angled edge of wedge 280, interfaces with cambered edge 271 of wedge bar 270
282 void or voids defined within a wedge
451 wheelie bar stiffener or leg stiffener
600 center hinge assembly, may comprise two attached cylinders with each cylinder defining two voids with each void having a pin inserted into a void 229 defined by the gear teeth 228 of a wheelie gear 220.
620 link cap
700 wheel mount
720 wheel These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein,"

"above," "below," and words of similar import, when used in this application, shall refer to this application as a whole and not to any particular portions of this application.

Referring to FIG. 1A, a perspective view of a disclosed embodiment 100 is shown in an expanded position. A disclose embodiment may include four top bars 205. The use of a plurality of top bars overcomes short falls in the art by enabling a folded position during storage, with such a folded position shown in FIG. 3. The use of a plurality of top bars allows for a very compact and self-standing lift, when the lift is not in use.

Figure 1B:
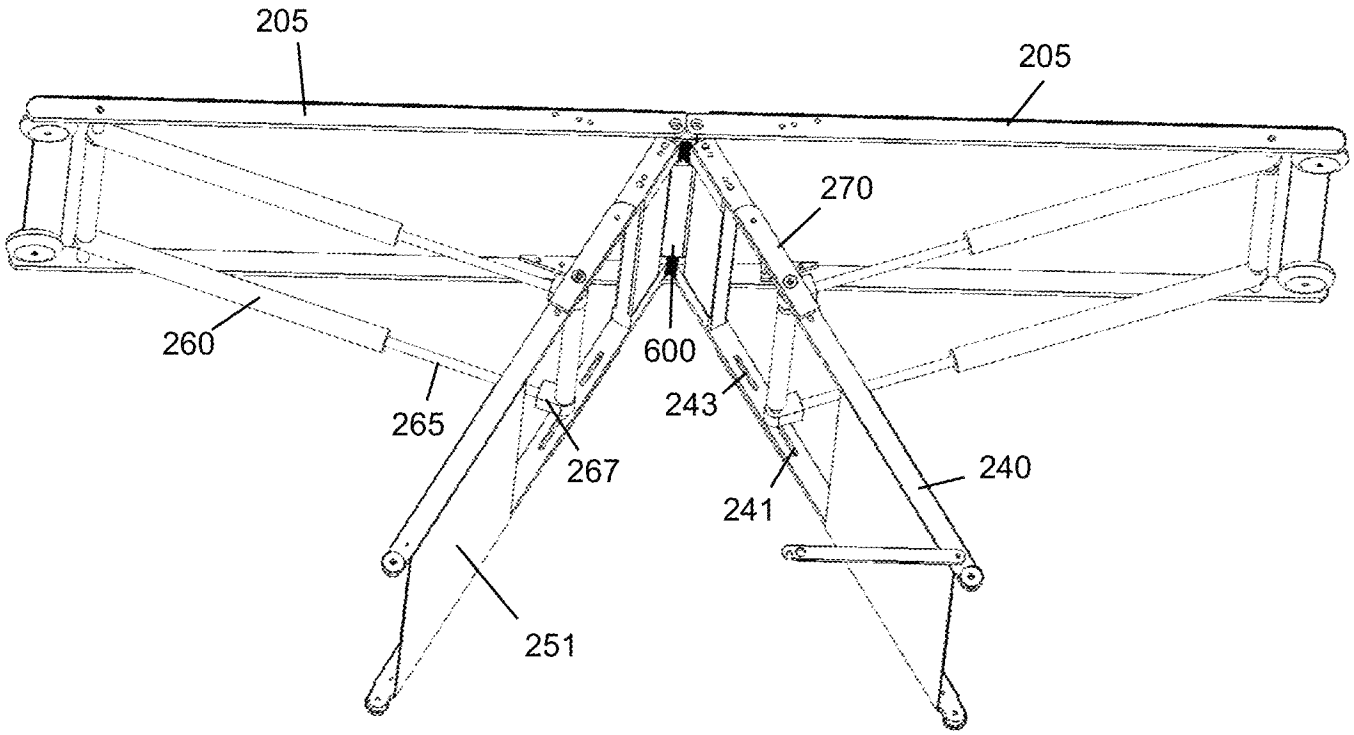
FIG. 1B is a perspective view of a lift system

FIG. 1B depicts a perspective view of a system wherein a plurality of top bars 205 are used and each top bar 205 may have a distal side pivotally attached to an upper cross bar 210 or cylinder rod cross head, with the upper cross bar having distal pin protrusions pivotally attached to a cylinder 260, with the cylinder in sliding attachment to a piston 265 with the piston in rotational attachment to lower cross bar 275 with the lower cross bar comprising (See FIG. 16) a main longitudinal body or section 278, distal ends comprising a retention area 279 and a distal insertion area 276. Referring back to FIG. 1B, a cylinder rod clevis 267 may be found between the distal end of the piston 265 and the distal side of the lower cross bar. The distal insertion area of the lower cross bar may be inserted through a longitudinal void 241 defined within a wheelie bar 240. The distal insertion area may further extend into or through a wedge bar 270. The wedge bar may travel or slide along the body of the wheelie bar 240 to assist in pressing the wedge bar into a wedge (See FIG. 5 part 280) so as to rotate the wheelie bar 240 away from the top bar 205.

A proximal side of the wheelie bar 240 may be attached to a wheelie gear 220 and the wheelie gear may be rotationally attached to a center hinge assembly 600 and the center hinge assembly may be attached to the mid-section or center section of the top bar 205. The distal ends of the wheelie bars 240 may be attached to wheels and/or a wheelie bar stiffener. The distal ends of each pair of wheelie bars may be attached to wheelie bar stiffeners 451. The optional wheelie bar stiffeners provide a mechanical advantage of keeping the pairs of wheelie bars in plane with one another.

Disclosed embodiments overcome shortfalls in the art by use of four piston or four systems of linear movement exerted between the top cross bar and the bottom cross bar. While a disclosed lift is in a flat position, the outward or expanding movement of each piston urges a wedge bar 270 into a wedge, initiating the rotational movement of the wheelie bar 240 away from a top bar 205. The artful configuration of the wedge bar sliding along the wheelie bar and the artful configuration of the lower cross bar being moved by the piston such that the lower cross bar transfers movement to the wedge bar provides a mechanical advantage in presenting a very flat initial position of the lift such that patients can be rolled on to the lift.

Disclosed embodiments overcome shortfalls in the art by use of four piston or four systems of linear movement exerted between the top cross bar and the bottom cross bar. While a disclosed lift is in a flat position, the outward or expanding movement of each piston urges a wedge bar 270 into a wedge, initiating the rotational movement of the wheelie bar 240 away from the top bar 205. The artful configuration of the wedge bar sliding along the wheelie bar and the artful configuration of the lower cross bar being moved by the piston such that the lower cross bar transfers movement to the wedge bar provides a mechanic advantage in presenting a very flat initial position of the lift such that patients can be rolled on to the lift.

The movement of the lower cross bar 275 within the longitudinal void 241 of the wheelie bar 240 provides a mechanical advantage of both initiating a vertical or separation movement between the wheelie bar 240 and top bar 205 and creating additional angle or additional rotation between the wheelie bar and top bar in both raising a patient and in returning the lift to its original flat position.

Figure 2A:
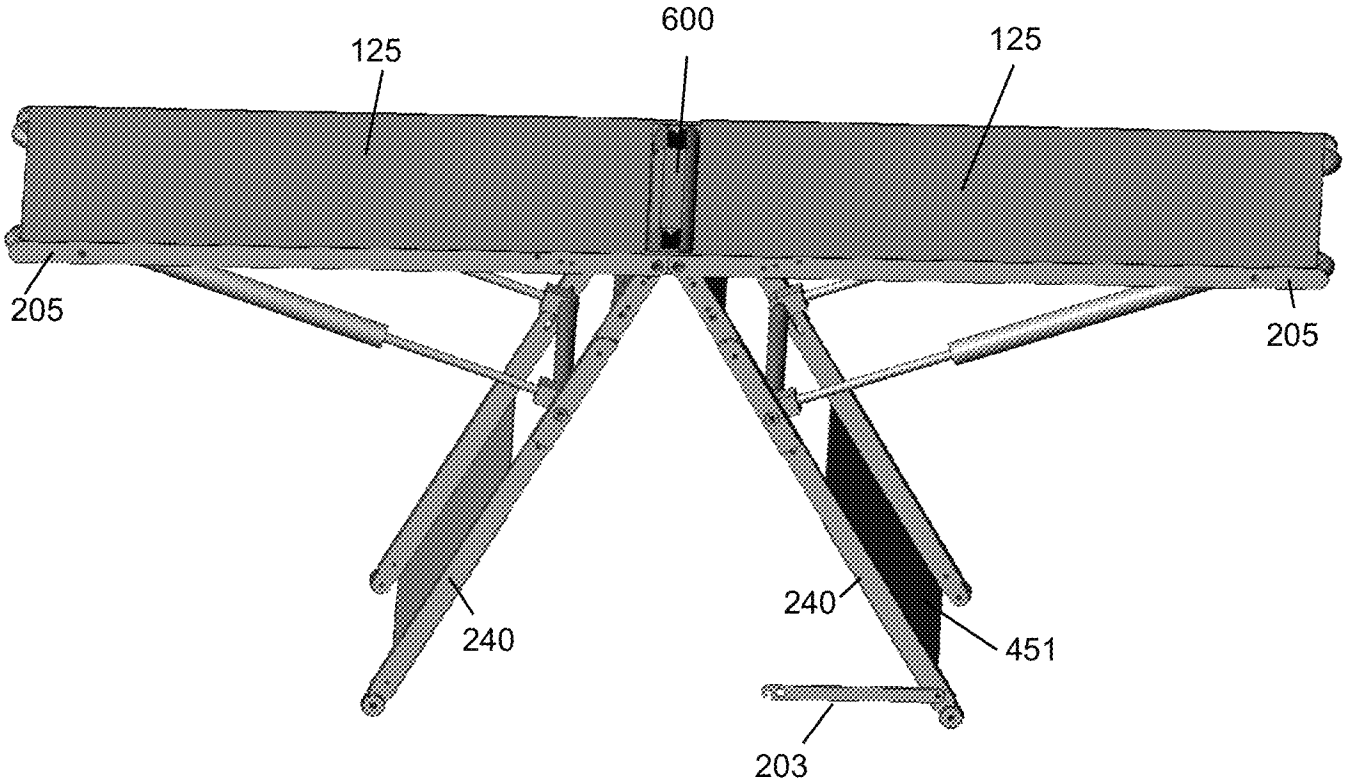
FIG. 2A is a perspective view of a lift system

FIG. 2A depicts a perspective view of a system shown in an expanded position with four top bars 205 held in parallel. In the expanded position shown, a patient may be raised from a very low position with mechanical means, thus preserving the backs of the involved health care workers. Disclosed embodiments may also include one or more wheelie bar stiffeners 451, each attached to a pair of wheelie bars 240.

Figure 2B:
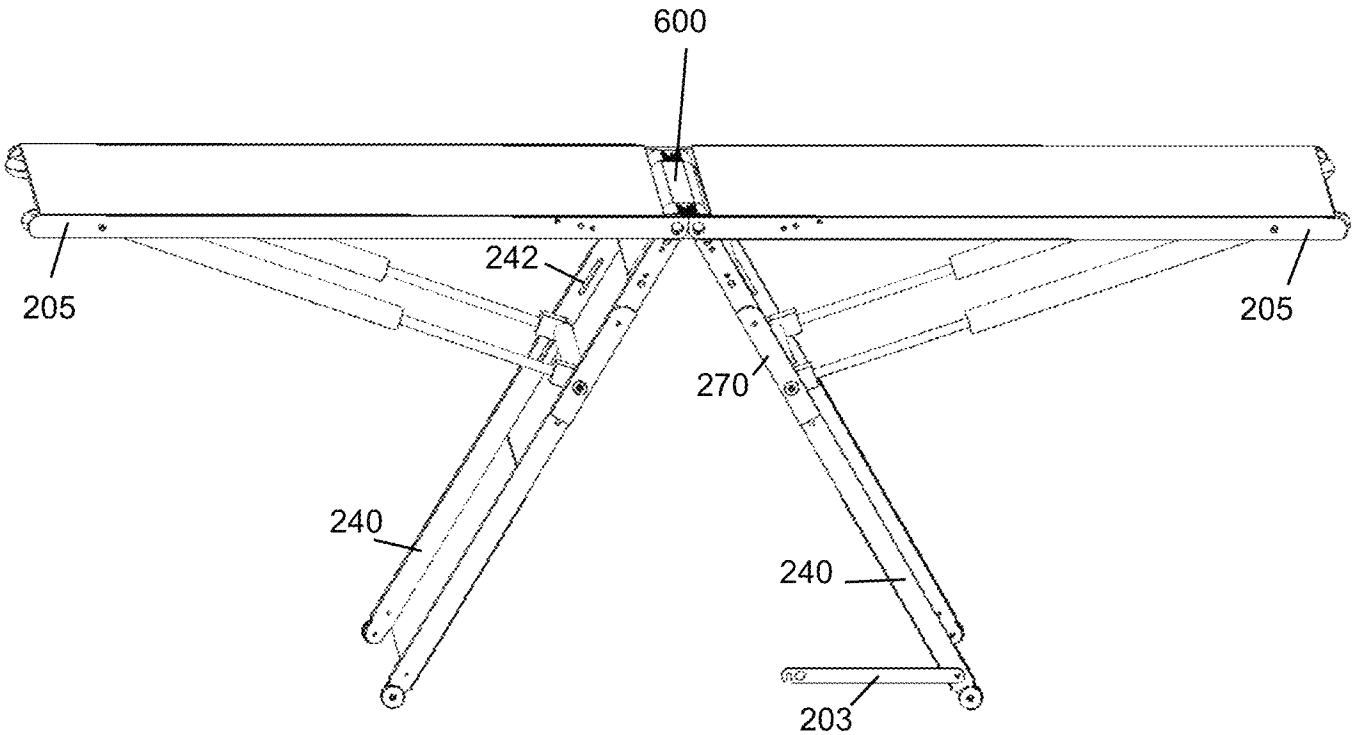
FIG. 2B is a perspective view of a lift system

FIG. 2B depicts a line view of FIG. 2A to better illustrate the shape of the wedge bar 270 and how the wedge bar moves along the wheelie bar 240.

Figure 3:
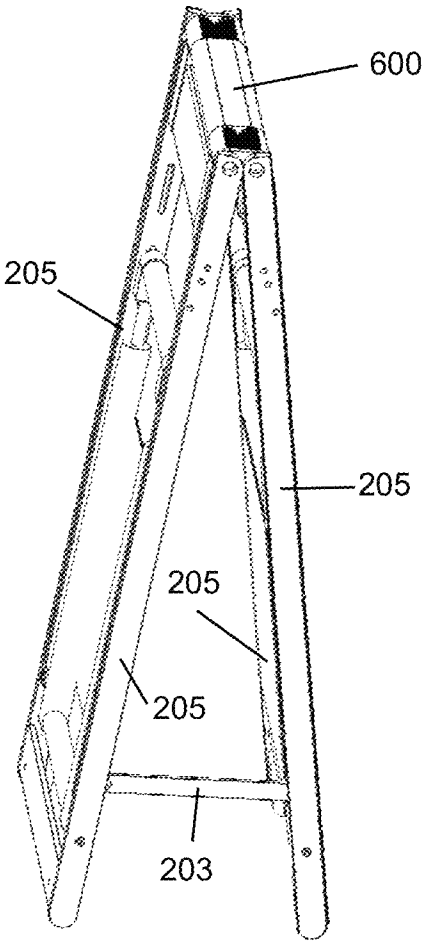
FIG. 3 is an perspective view of a lift system in a folded or storage position

FIG. 3 depicts a disclosed system in a folded self-standing position, made possible by the use of four top bars 205.

Figure 4:
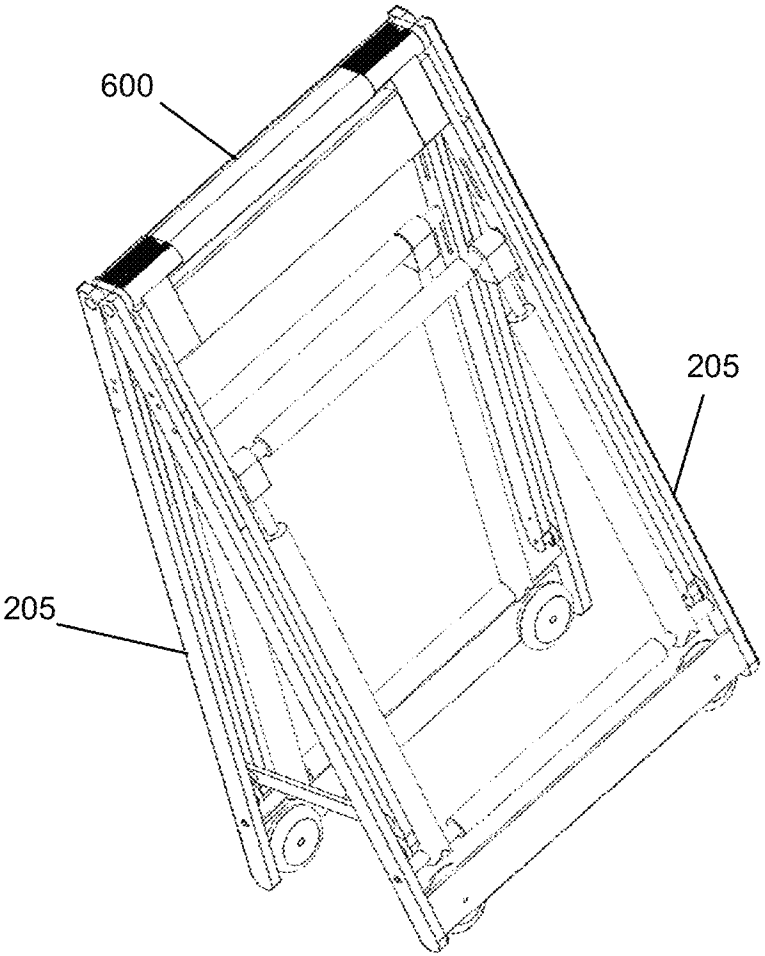
FIG. 4 is an perspective view of a lift system in a folded or storage position

FIG. 4 depicts a disclosed system in a folded self-standing storage position.

Figure 5:
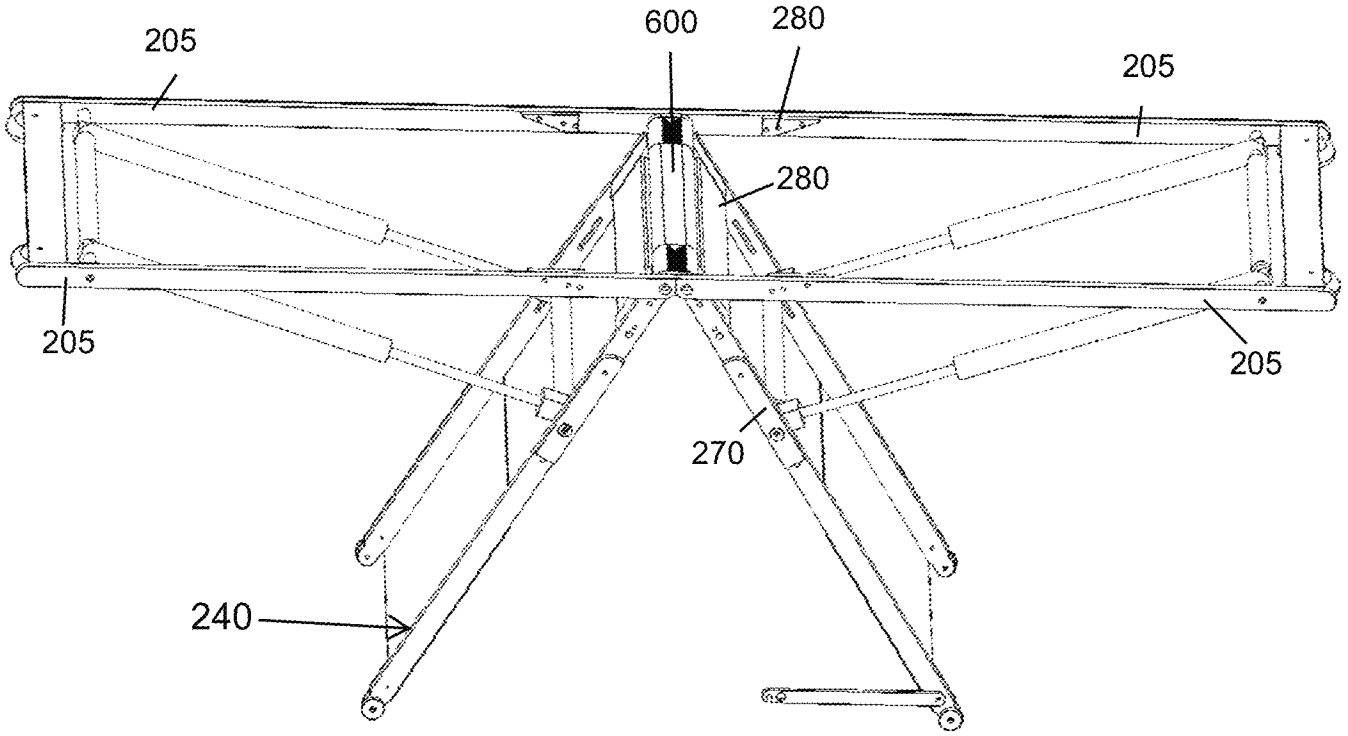
FIG. 5 is a perspective view of lift system

FIG. 5 depicts a disclosed system in an expanded position. To initiate movement from a flat position, the cambered edges of the wedge bars 270 press upon the angled edges of the wedges 280.

In a four piston embodiment, four top bars 205 may each be attached to one wedge 280 each, for a total of four wedges used. Each top bar may have a proximal end pivotally attached to a center assembly 600. On either side of the center assembly a wheelie gear 220 may be in rotational attachment to the center assembly. Moreover, each of the two wheelie gears 220 may comprise (see FIG. 18) a cross bar 221, the cross bar having two distal ends each attached to a side bar 224 with each side bar attached to a set of gear teeth 227 with the set of gear teeth defining a pivot void 229. The pivot void 229 may be in rotational attachment with the center assembly.

Also, the pivot void 229 may be used to secure a pin or other means of hingedly attaching the proximal end of a top bar. The disclosed embodiments overcome shortfalls in the art by providing compact means of hinged attachment of the four top bars by the integral use of the wheelie gear, thus extra parts or extra assemblies are not needed to integrate the rotating top bars.

Referring back to FIG. 5, a first wheelie gear 220 may be in geared attachment to a second wheelie gear, by use of each wheelie gear's set of gear teeth. The geared attachment of the first wheelie gear to the second wheelie gear provides a mechanical advantage in the four piston embodiment in that the two sets of wheelie bars are forced to move at the same speed. A first set of wheelie bars may be attached to the first wheelie gear and a second set of wheelie bars may be attached to a second wheelie gear. The respective wheelie bars may be fixedly attached to a corresponding wheelie bar such that a set of wheelie bars will not rack or otherwise become askew. The geared connection of each wheelie gear ensured that both sets of wheelie bars or both sides of the lift rise and lower in unison. The lateral ends of the two wheelie gears may provide hinged attachment to the four top bars.

To assist in the movement of the system from a flat position to an expanded position, each of the four wedge bars 270 is slidably attached to one of the four wheelie bars 240. Starting in a flat position, a piston rod 265 is attached to a cylinder rod clevis 267, with the clevis attached to a cross bar 275, the cross bar having distal ends extending through a wheelie bar 240 and the cross bar distal ends attached to a wedge bar 270. As the piston rod is outwardly urged, by use of pressure added to a cylinder 260, the wedge bar 270 is moved into a wedge 280, with the wedge having an angled edge 281 (shown in FIG. 17) urging the wedge bar to move upwardly which in turn causes the attached wheelie bar 240 to move into a more vertical position.

Figure 6:
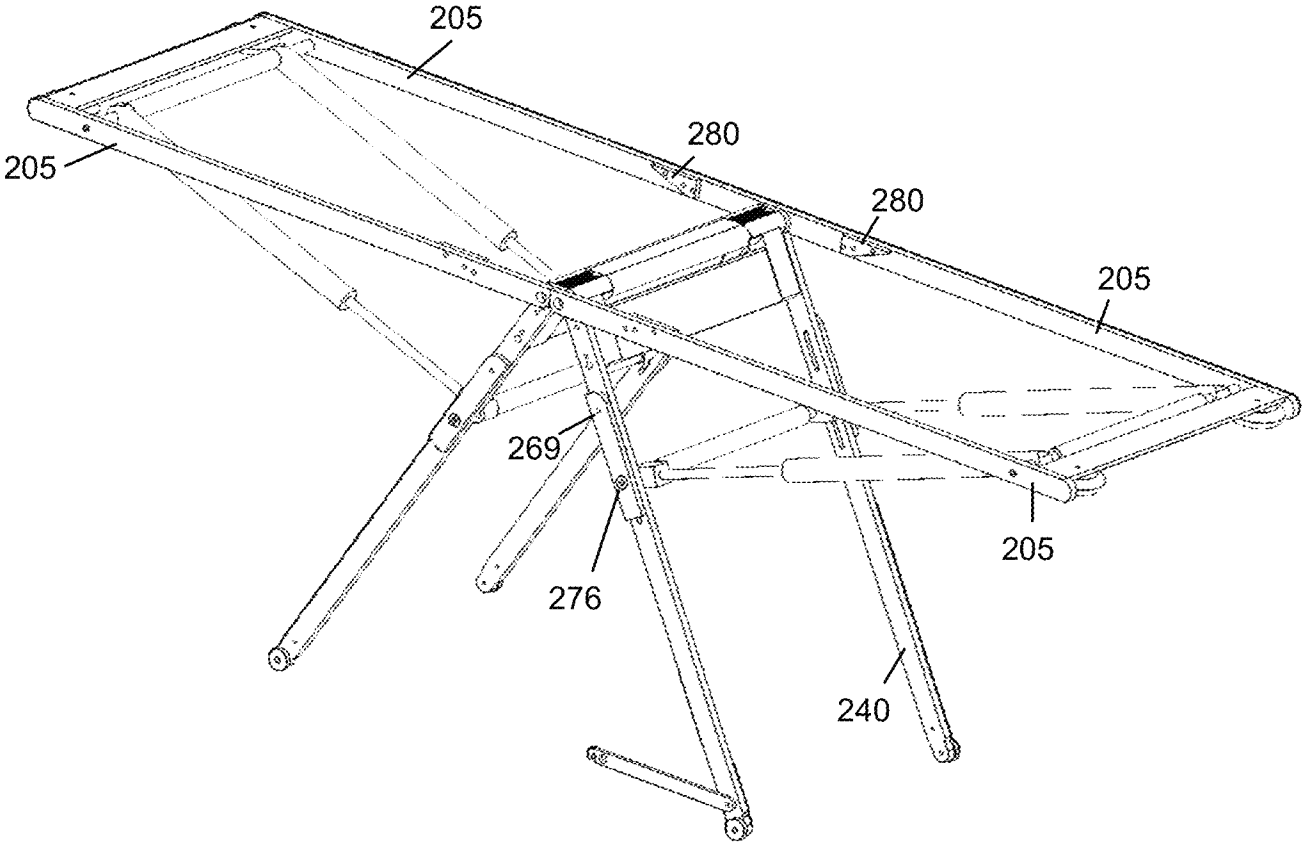
FIG. 6 is a perspective view of lift system

FIG. 6 depicts a perspective view of a system in an expanded position. A plurality of wedges 280 are depicted, with each wedge in fixed attachment to a top bar 205, with four top bars in use. The use of one wedge for each of the four top bars provides a mechanical advantage in allowing for the use of four rotating straight top bars 205 which allows for the compacted storage of the unit in an upright position with such a position sometime similar to that of a folded ping pong table. The use of four top bars provides more convenient folded storage options. The use of four top bars also provides a mechanical advantage in providing convenient means of rolling folded storage that eschews hanging the system upon a wall.

Figure 7:
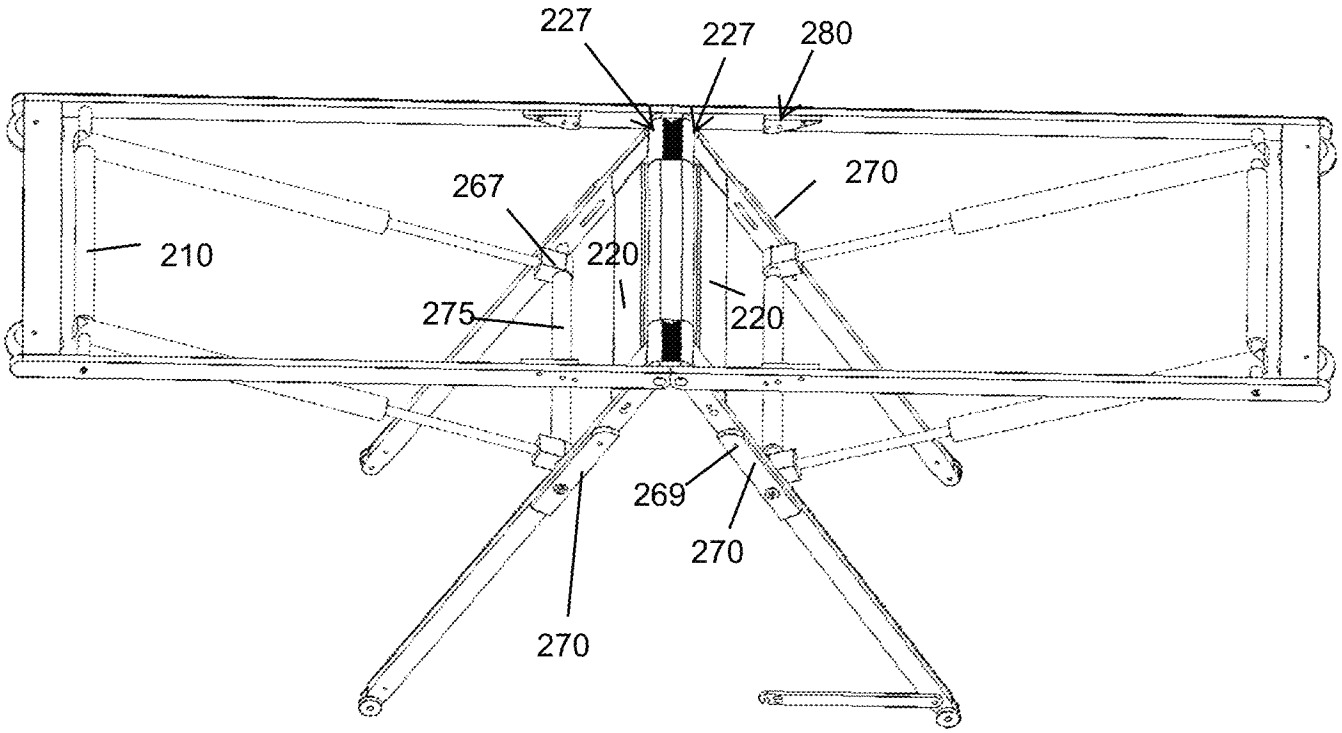
FIG. 7 is a perspective view of lift system

FIG. 7 depicts a perspective view of a system in an expanded position. A cylinder rod cross head 210 or upper cross bar is attached to a cylinder and piston, with the piston attached to a cylinder rod clevis and the cylinder rod clevis is attached to a lower cross bar 275. A first wheelie gear 220 is shown to be in geared attachment to a second wheelie gear 220.

Figure 8:
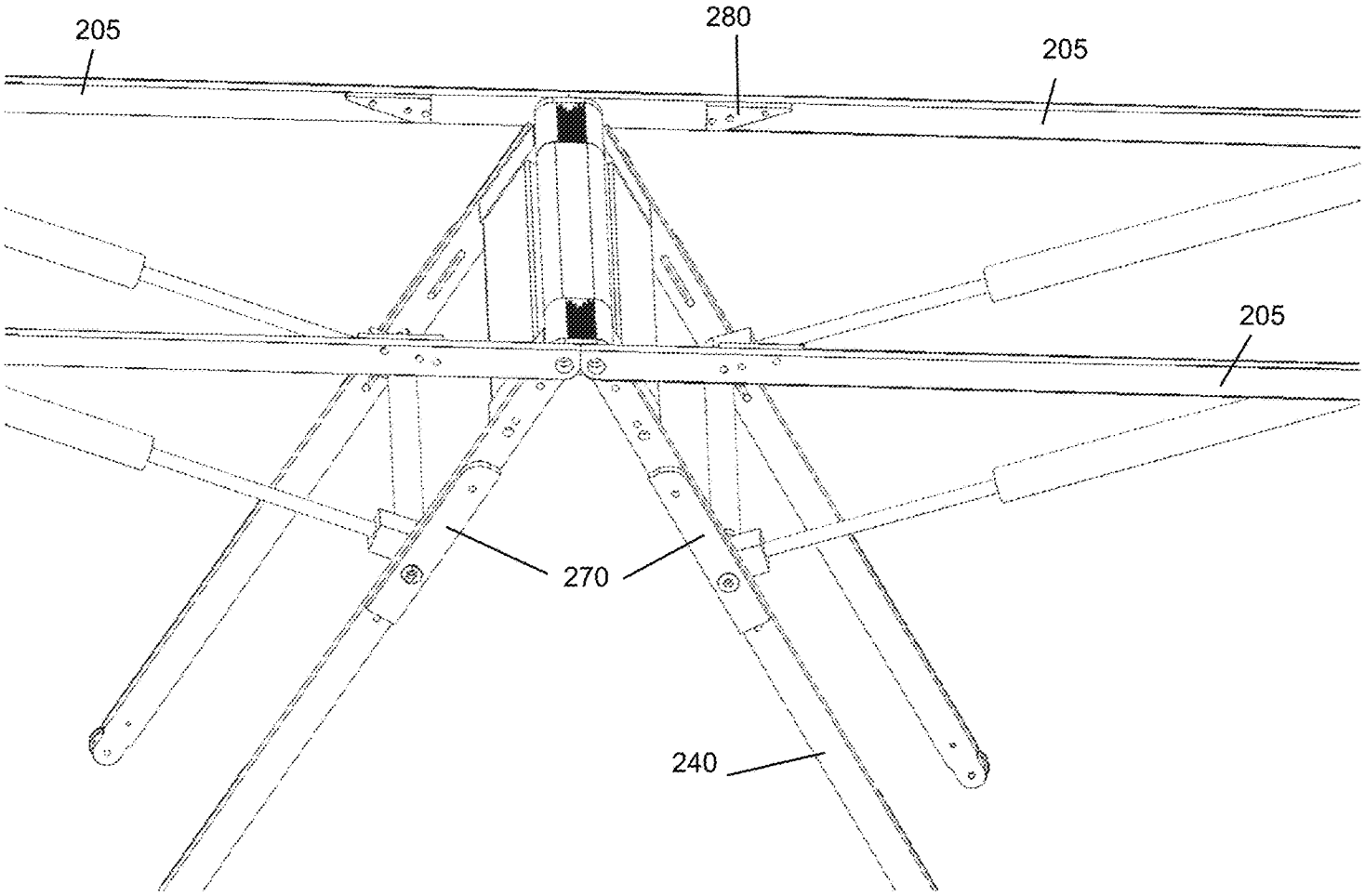
FIG. 8 is a perspective view of disclosed components

FIG. 8 depicts perspective view of a folding embodiment in an expanded position. Four pivoting top bars 205 are used.

Figure 9:
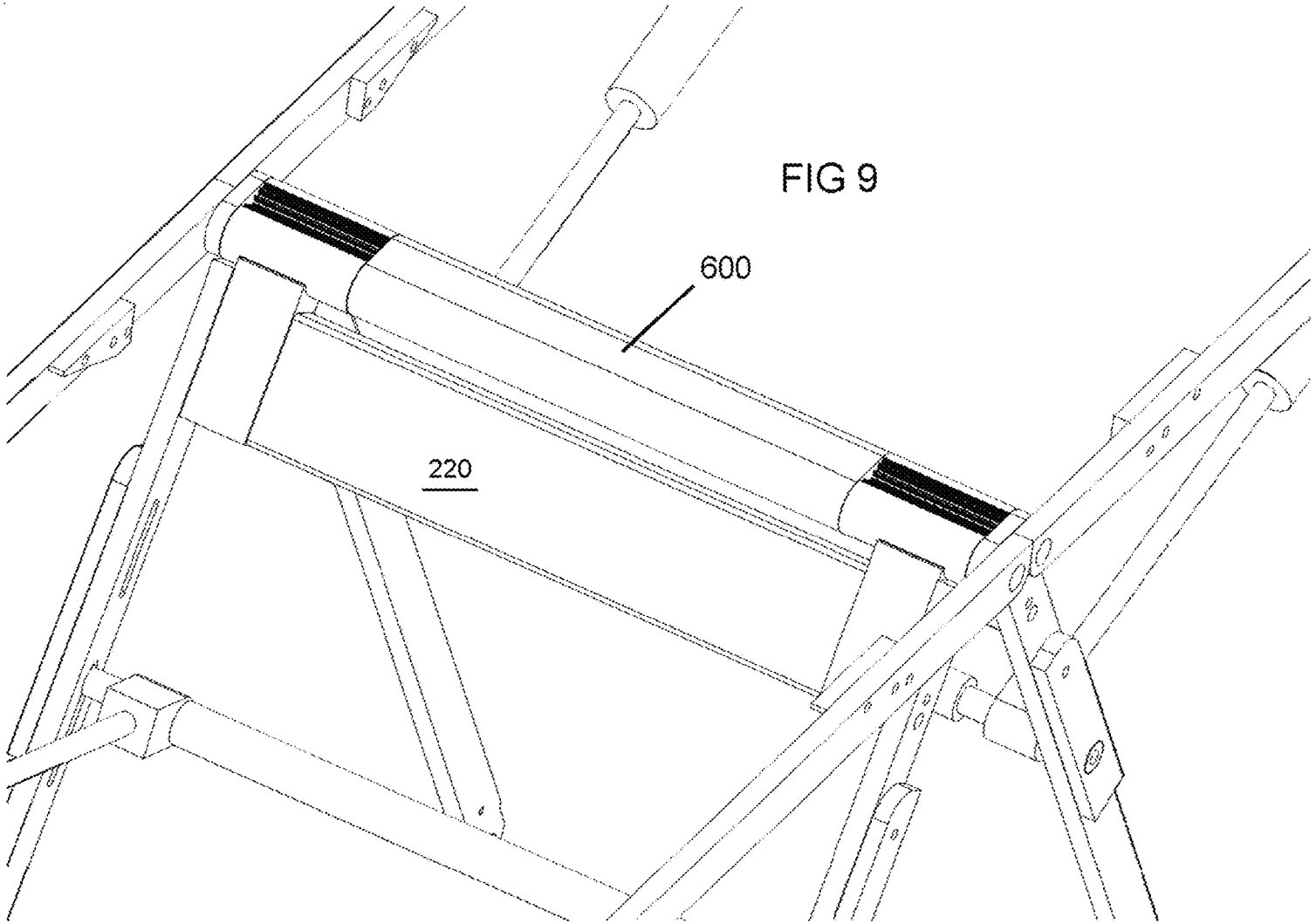
FIG. 9 is a perspective view of disclosed components

FIG. 9 depicts a wheelie gear 220 and surrounding components.

Figure 10:
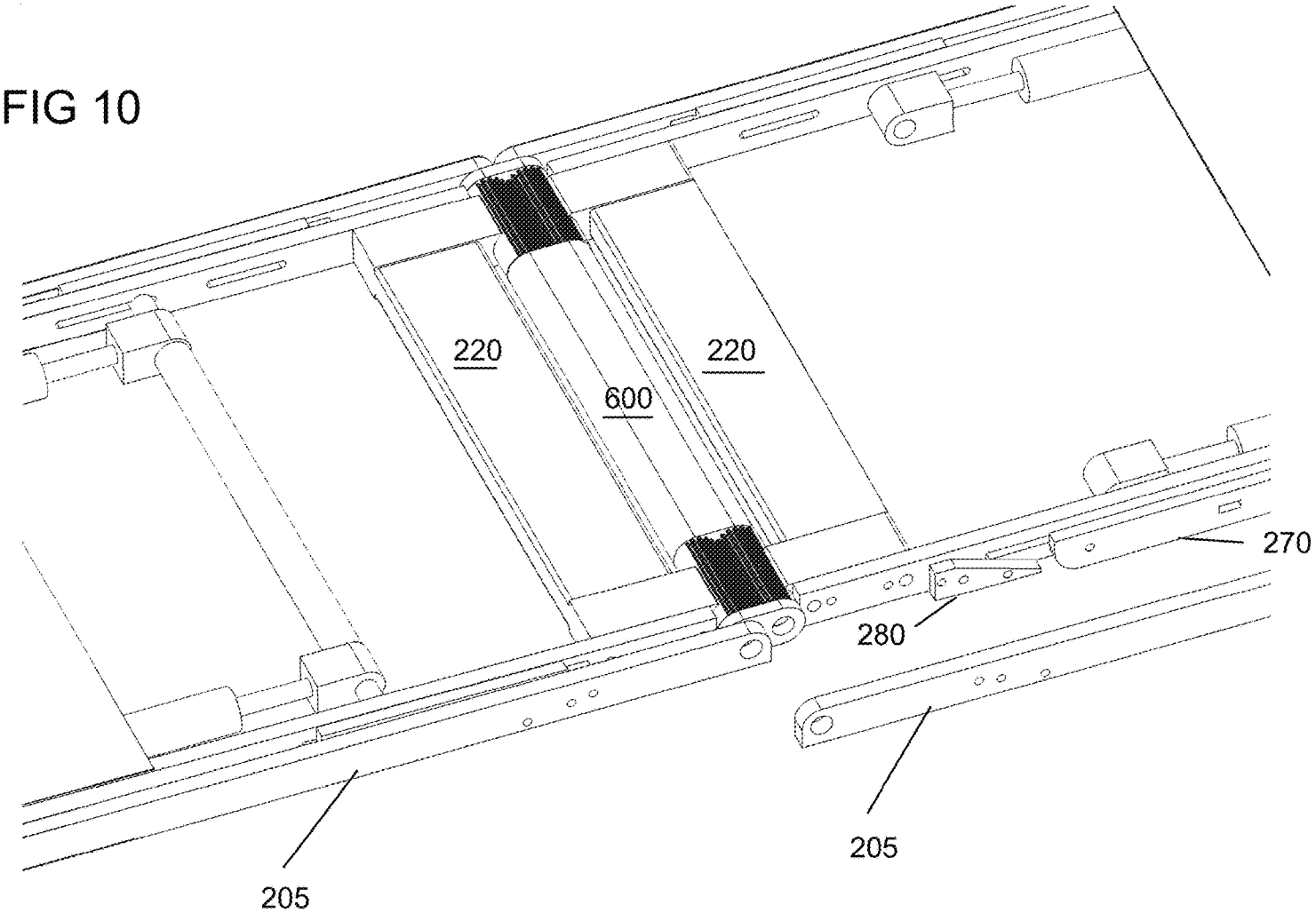
FIG. 10 is a perspective view of disclosed components

FIG. 10 depicts disclosed components while the lift is in a flat position.

Figure 11:
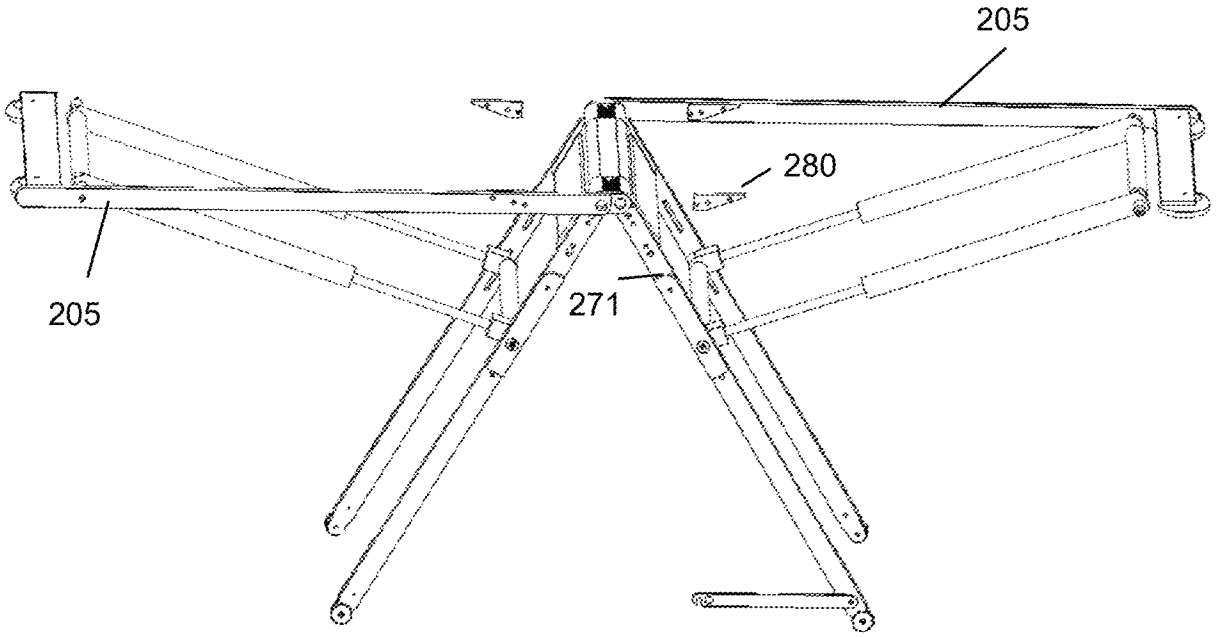
FIG. 11 is a perspective view of disclosed components

FIG. 11 depicts a perspective view of a frame with just two of the four top bars 205 shown. All four wedges are shown with three being easily visible. The illustrated wedges 280 help to show the relationship between the wedges and the cambered sides 271 of the wedge bars.

Figure 12:
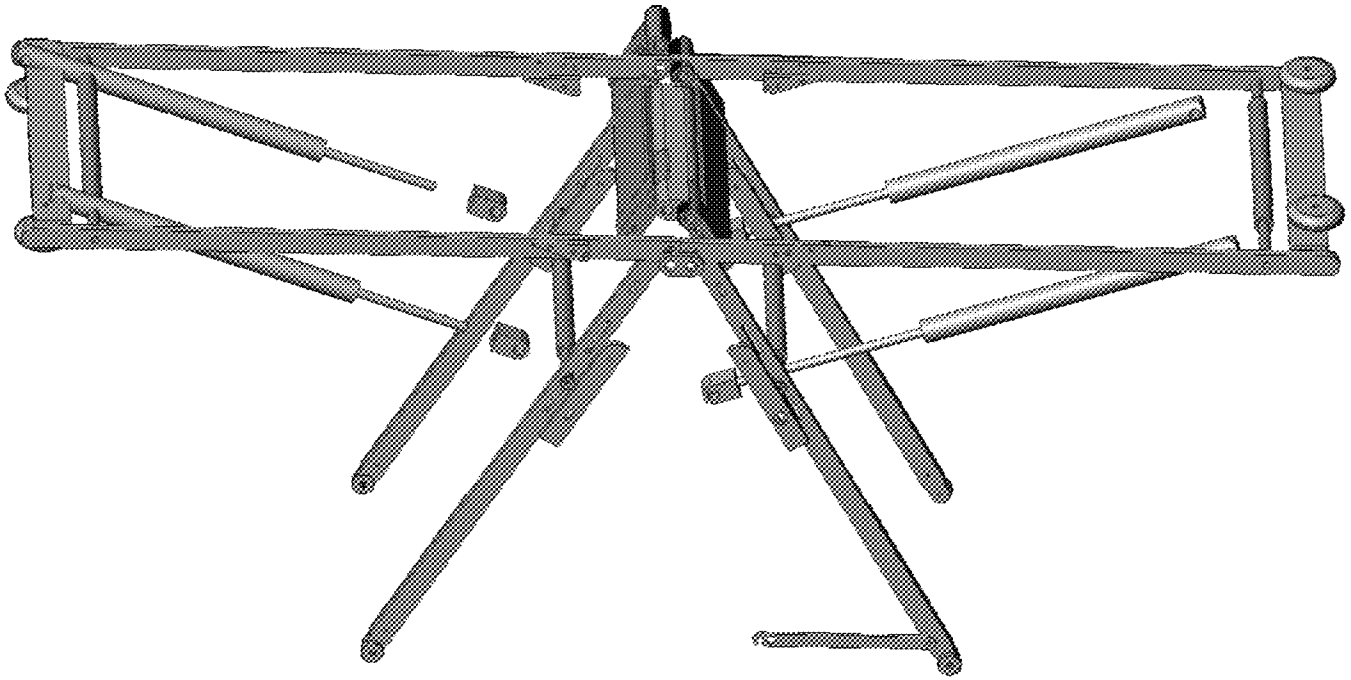
FIG. 12 is an exploded view of disclosed components

FIG. 12 depicts an exploded view of various components.

Figure 13A:
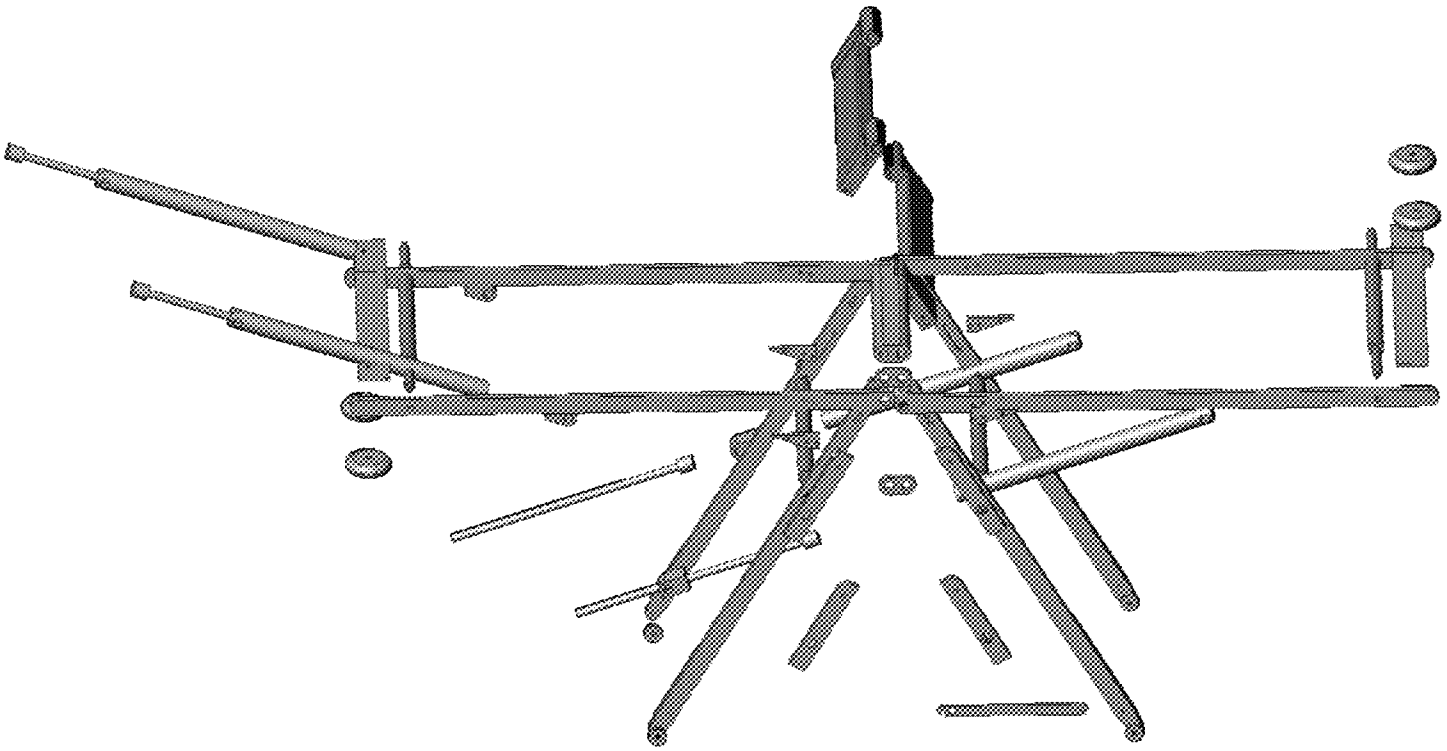
FIG. 13A is an exploded view of disclosed components

FIG. 13A depicts an exploded view of various components.

Figure 13B:
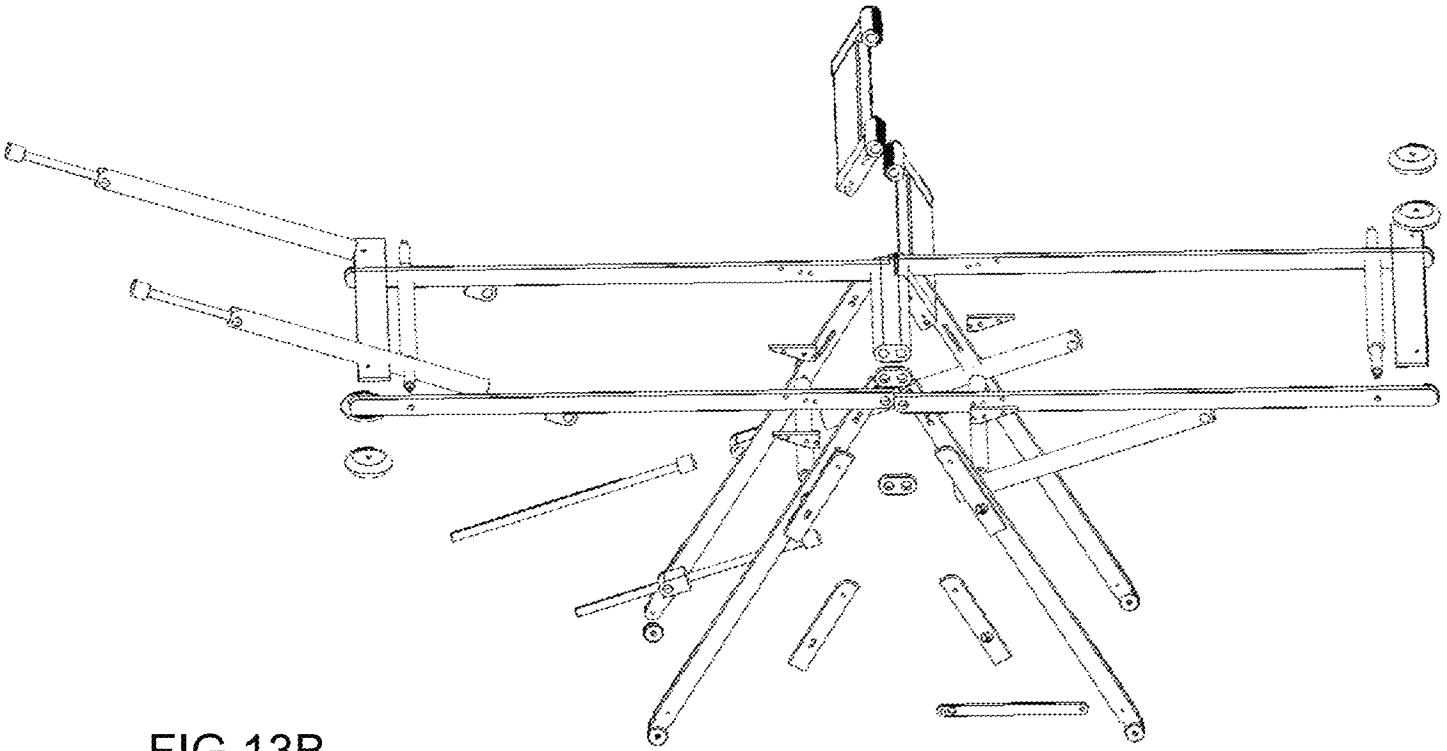
FIG. 13B is an exploded view of disclosed components

FIG. 13B depicts an exploded view of various components.

Figure 14:
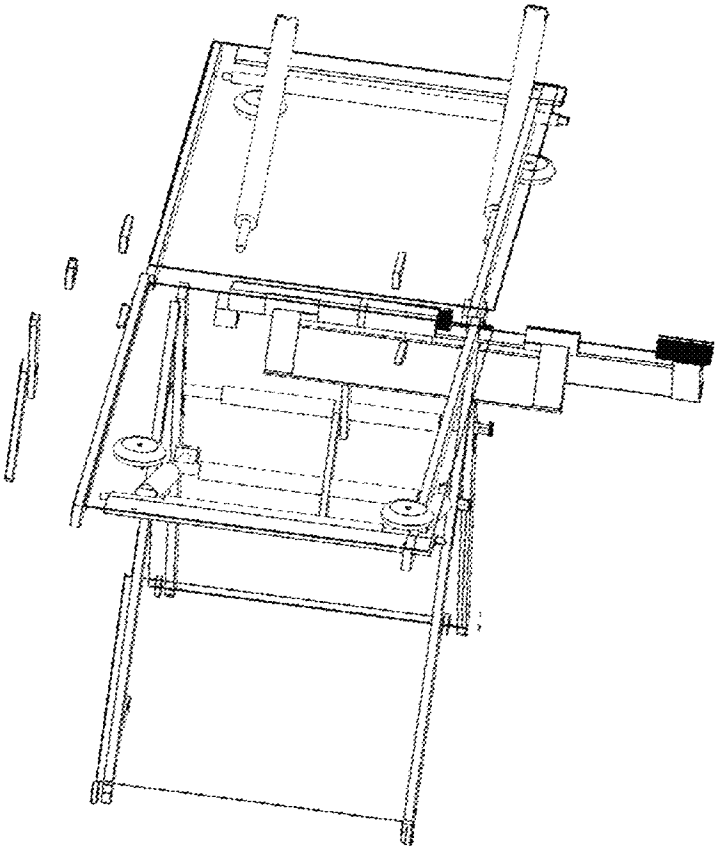
FIG. 14 is an exploded view of disclosed components

FIG. 14 depicts an exploded view of various components.

Figure 15A:
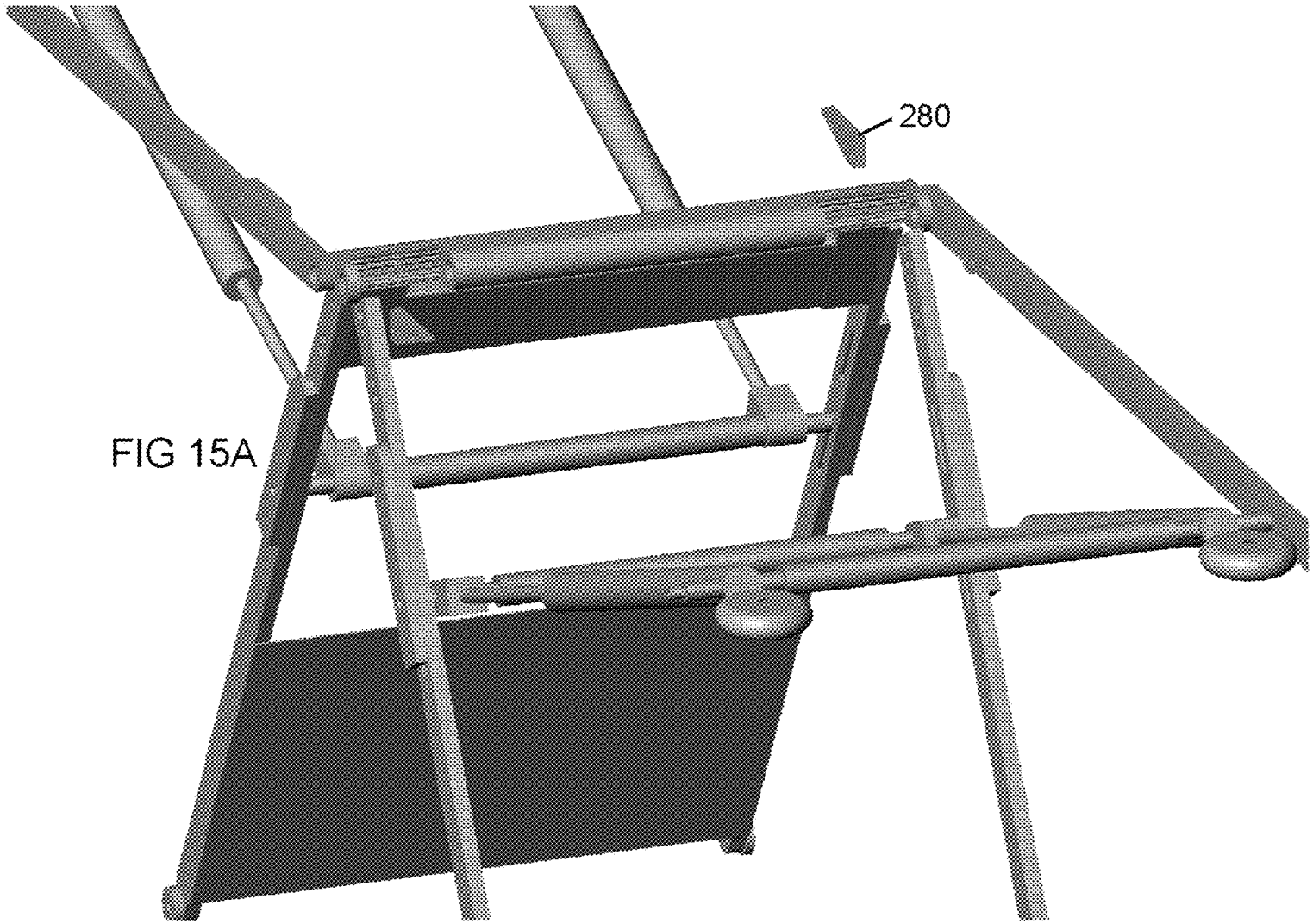
FIG. 15A is a perspective view of disclosed components

FIG. 15A depicts various components with a wheelie gear removed from the foreground.

Figure 15B:
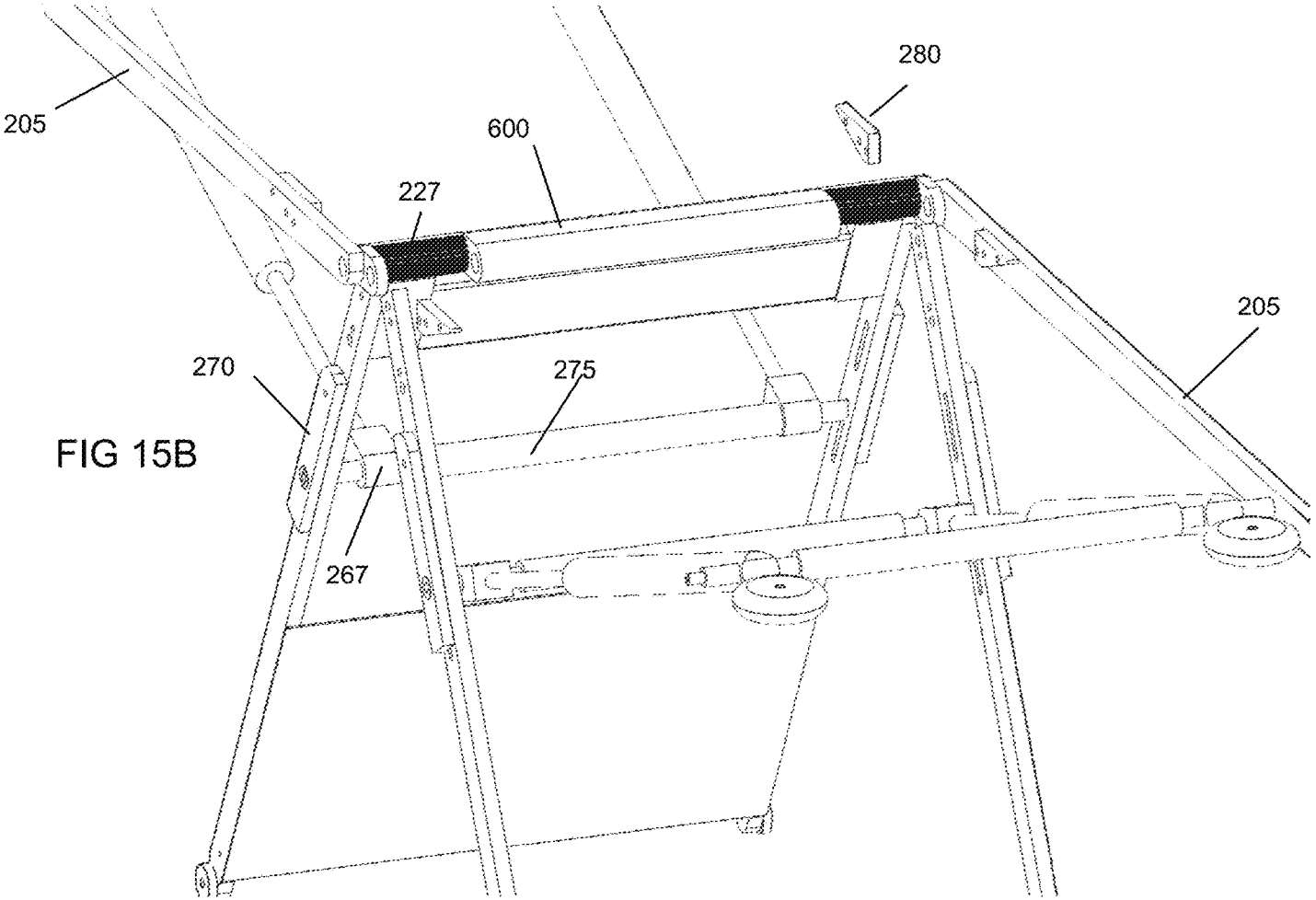
FIG. 15B is a perspective view of disclosed components

FIG. 15B depicts various components with a wheelie gear removed from the foreground.

Figure 16:
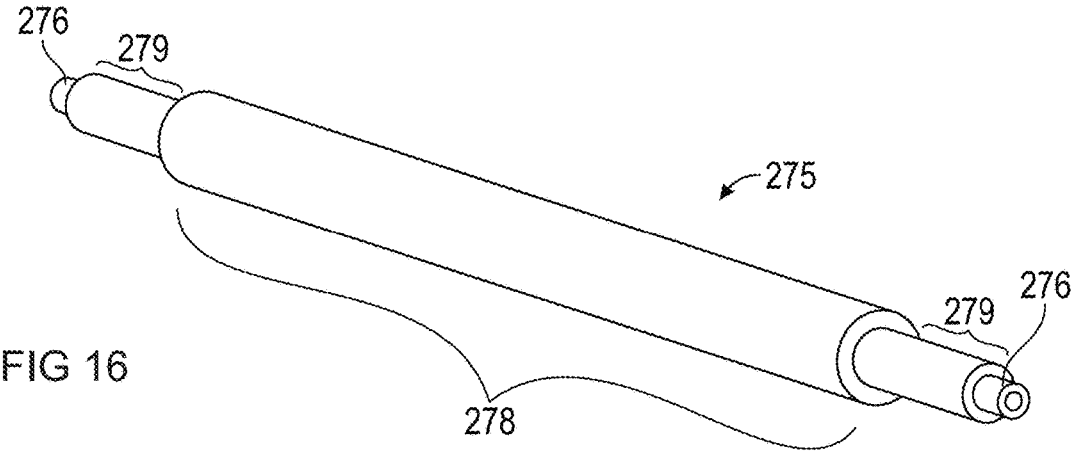
FIG. 16 is a perspective view of a cross bar

FIG. 16 depicts an upper cross bar 275, similar to a lower cross bar 210. An upper cross bar may comprise a main longitudinal section 278 having two distal sides with each distal side comprising retention area 279 and an outer distal insertion area 276. A distal insertion area 276 may be round or rectangular in shape. A distal insertion area 276 may be inserted into the first longitudinal void 241 of a wheelie bar 240 and the distal insertion area may further reach and move a wedge bar 270.

Figure 17:
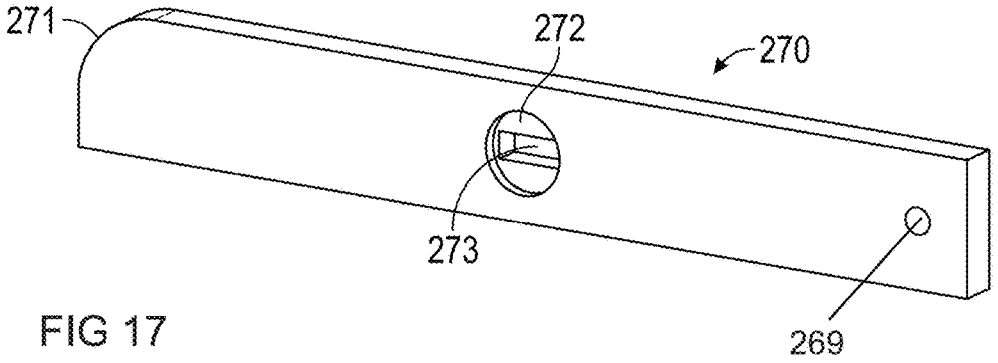
FIG. 17 is a perspective view of a wedge bar

FIG. 17 depicts a wedge bar 270 and a wedge bar may comprise a cambered edge 271, the cambered edge sometimes used press upon or used to be deflected by a wedge 280. A wedge bar may define an indent area 272 and further define a void 274, the void sometimes used to accept a distal end of a lower cross bar 275 or distal insertion area 276. A wedge bar 270 may also define a second void 269, the second void sometimes used to secure a pin, the pin contained within the second void 243 of a wheelie bar 240.

Figure 18:
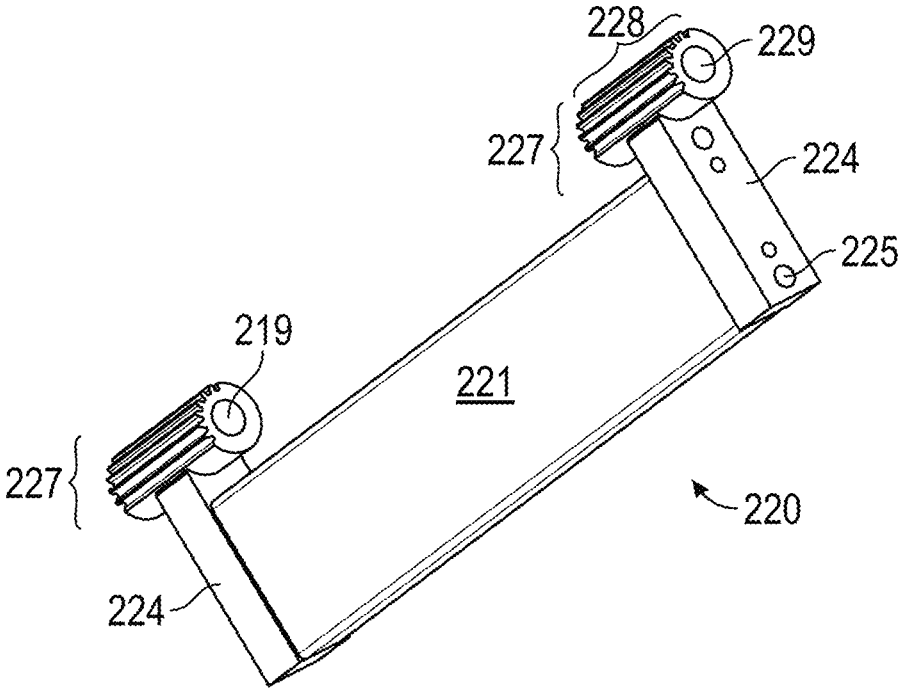
FIG. 18 is a perspective view of a wheelie gear

FIG. 18 depicts a perspective view of a wheelie gear 220. A wheelie gear may comprise a cross bar 221 having distal sides, each distal side may be attached to side bar 224 and each side bar may comprise a set of gear teeth 227, with the gear teeth defining a pivot void 229. The pivot 229 may be used to retain a pin inserted into a void of the center hinge assembly 600. The configuration and use of two wheelie gears provides mechanical advantages and overcomes shortfalls in the related art in that the gear teeth 227 are disposed in the same horizontal plane as the side bar 224 and cross bar 221. Thus, the two wheelie gears may start out in a flat position to help achieve the low initial profile of the lift. The horizontal walls 228 of the gear teeth provide a mechanical advantage of increasing the rotational surface area used to raise the lift. The use of relatively wide horizontal walls also allows the overall configuration of the lift to be very flat in the initial flat position.

Figure 19:
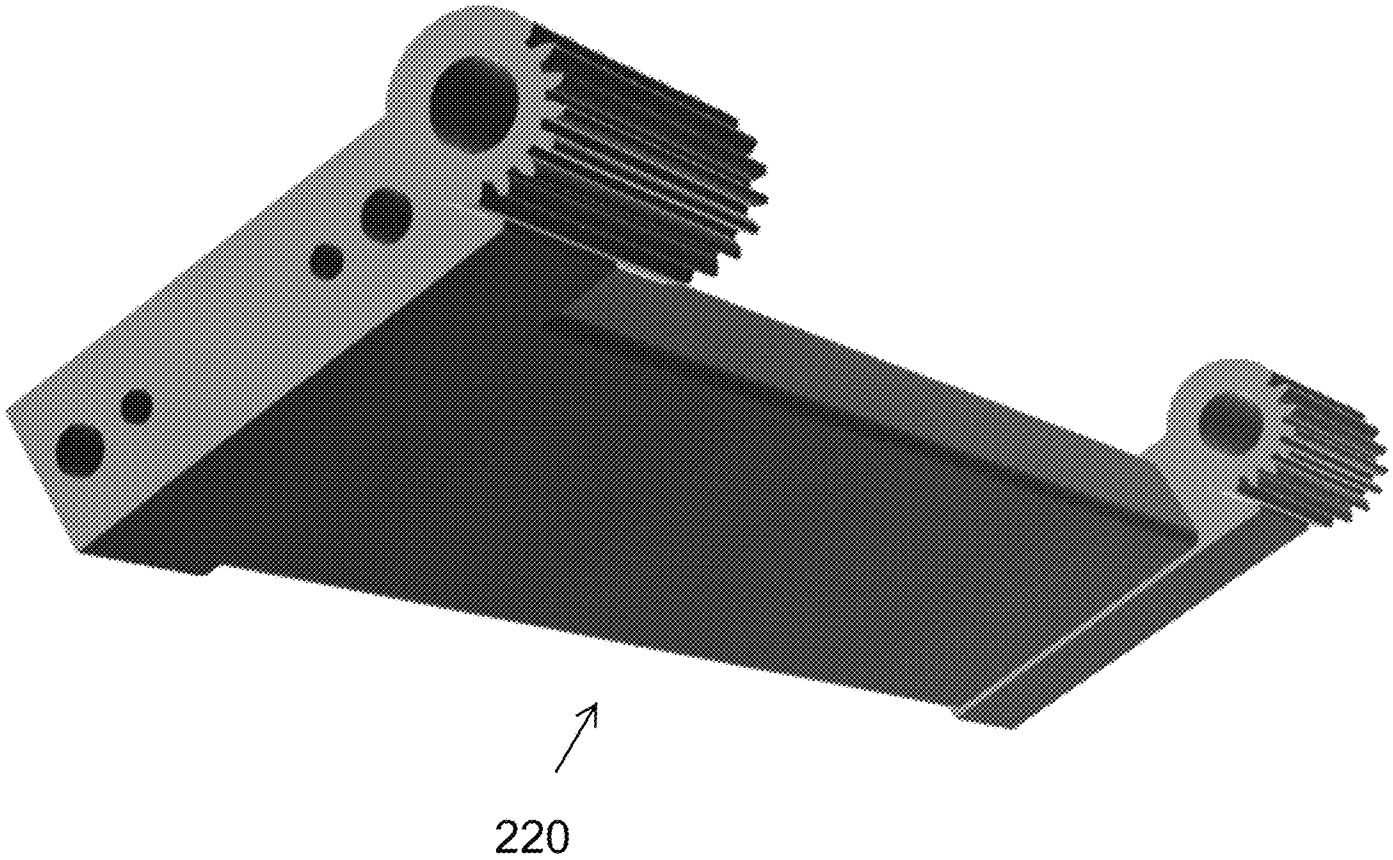
FIG. 19 is a perspective view of a wheelie gear

FIG. 19 depicts a perspective view of a wheelie gear 220.

Figure 20:
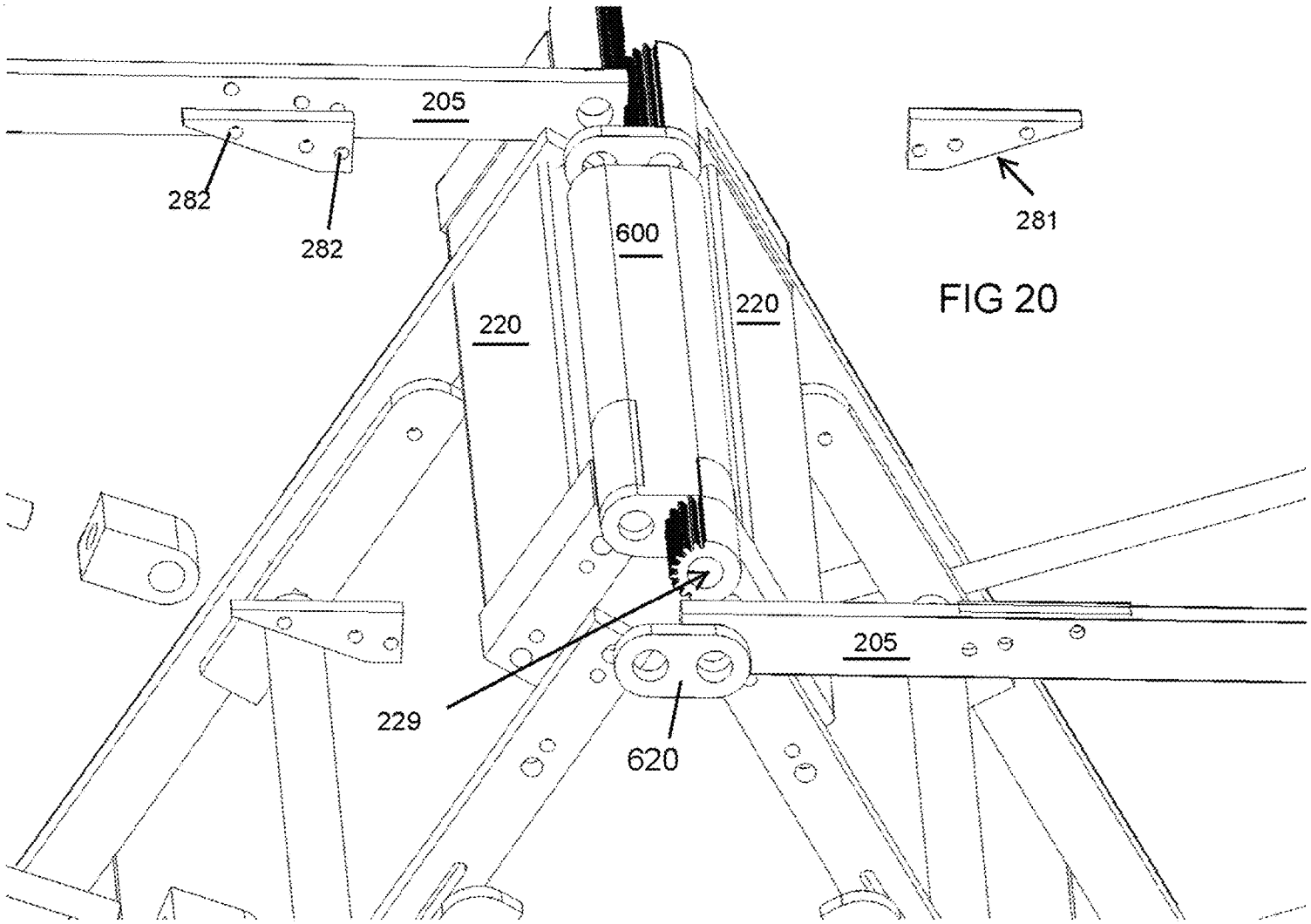
FIG. 20 is a perspective view of disclosed components

FIG. 20 depicts disclosed components in exploded position and illustrates means of rotational attachment of the four top bars.

Figure 21:
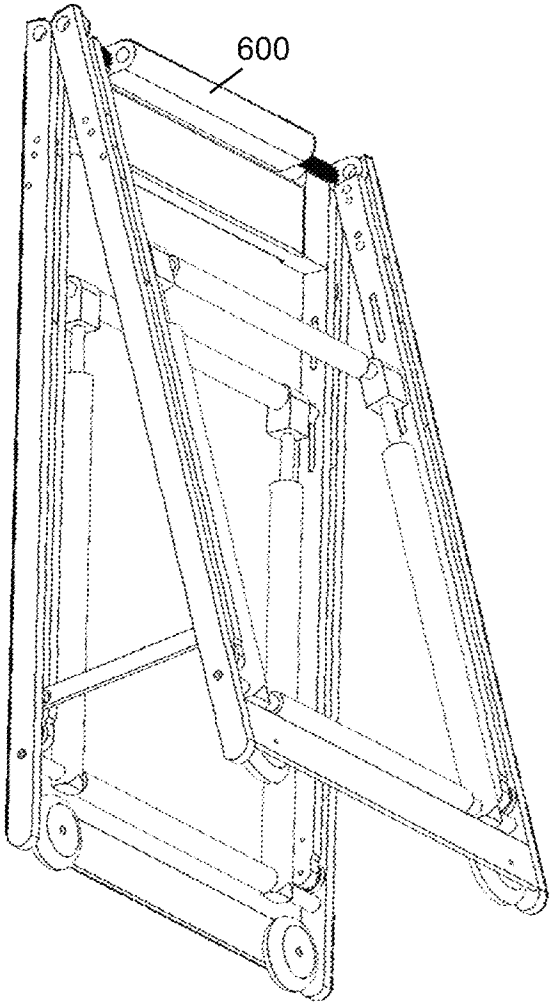
FIG. 21 is a perspective view of a lift system in a folded or storage position

FIG. 21 depicts center assembly 600 attached to a lift in a folded position.

Figure 22:
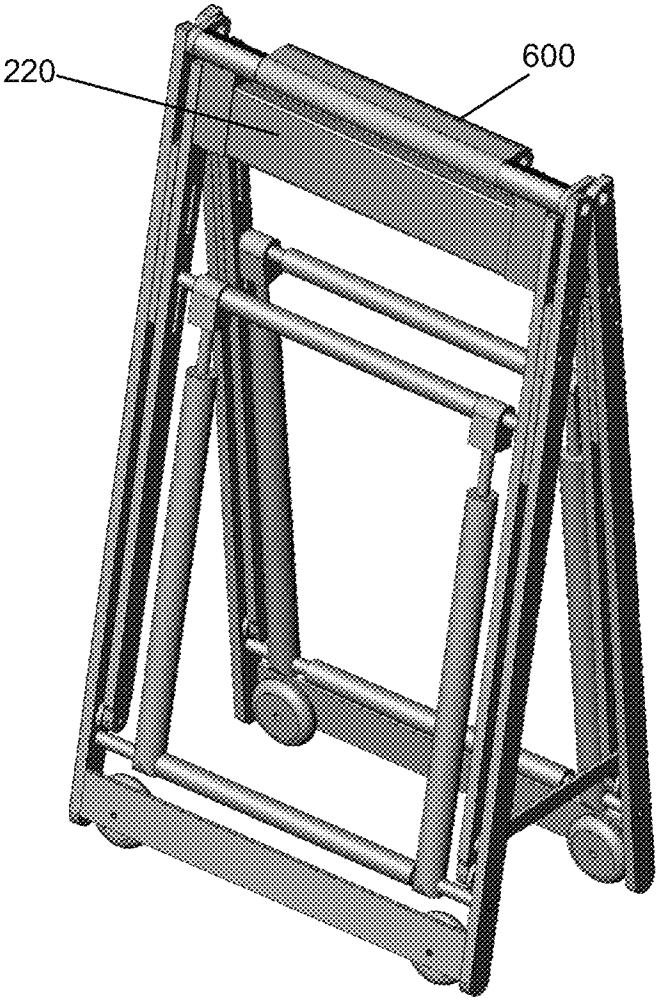
FIG. 22 is a perspective view of a lift system in a folded or storage position

FIG. 22 depicts a center assembly 600 in relation to a first wheelie gear 220 with the second wheelie gear removed.

Figure 23:
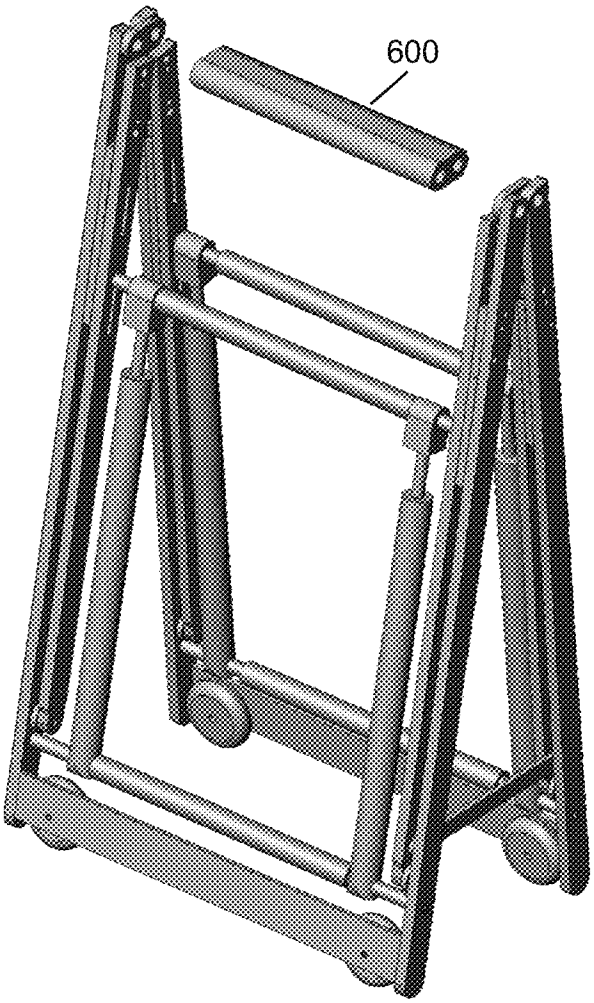
FIG. 23 is a perspective view of disclosed components

FIG. 23 depicts a center assembly 600 with the first and second wheelie gears removed.

Figure 24:
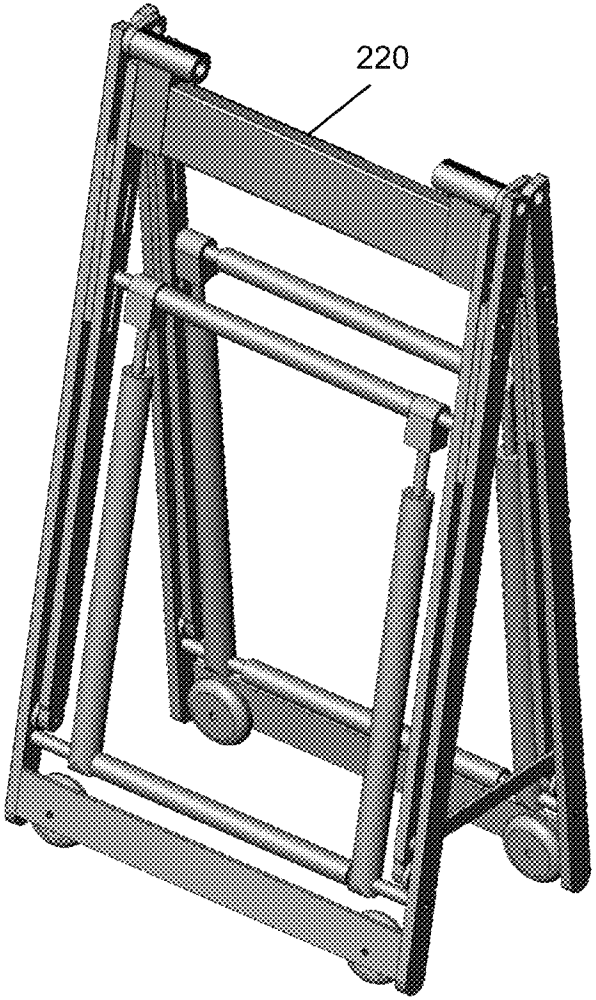
FIG. 24 is a perspective view of disclosed components

FIG. 24 depicts a first wheelie gear with the center assembly and second wheelie gear removed.

Figure 25:
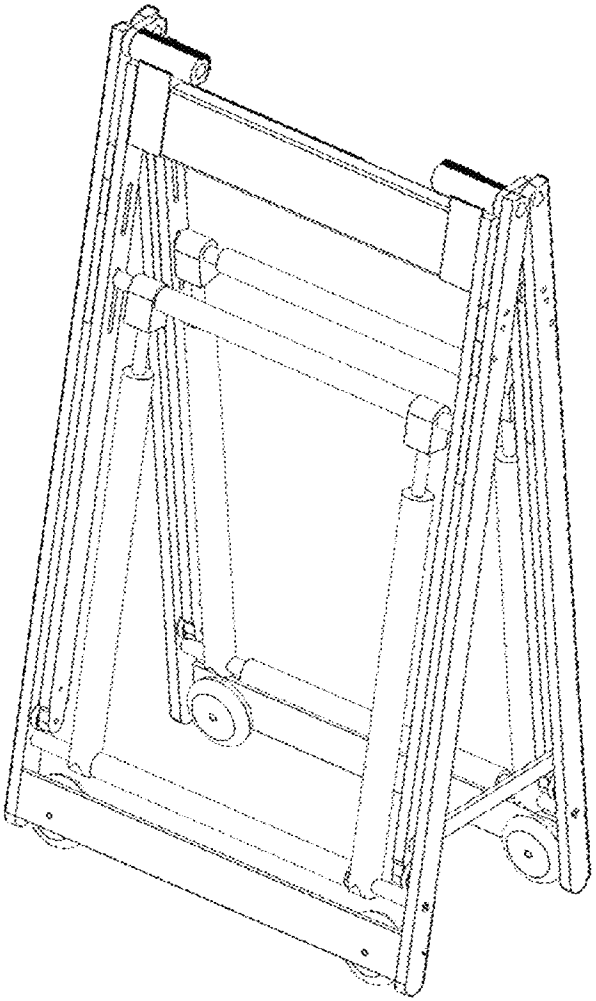
FIG. 25 is a perspective view of disclosed components

FIG. 25 depicts a line view of FIG. 24.

Figure 26:
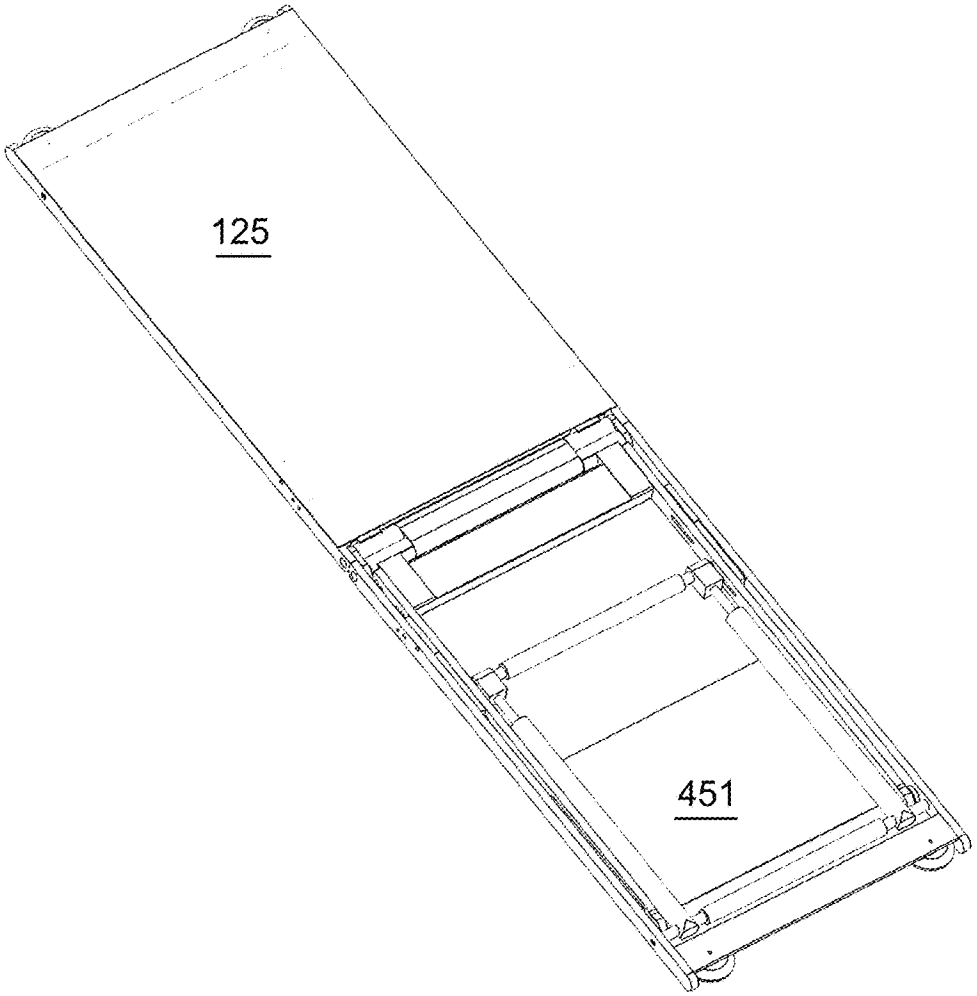
FIG. 26 depicts a perspective view of disclosed components

FIG. 26 depicts various components while the lift is in a flat position. In the background, a back board is shown, while in the foreground, the back board has been removed to reveal parts below, such as an optional wheelie bar stiffener 451.

Figure 27:
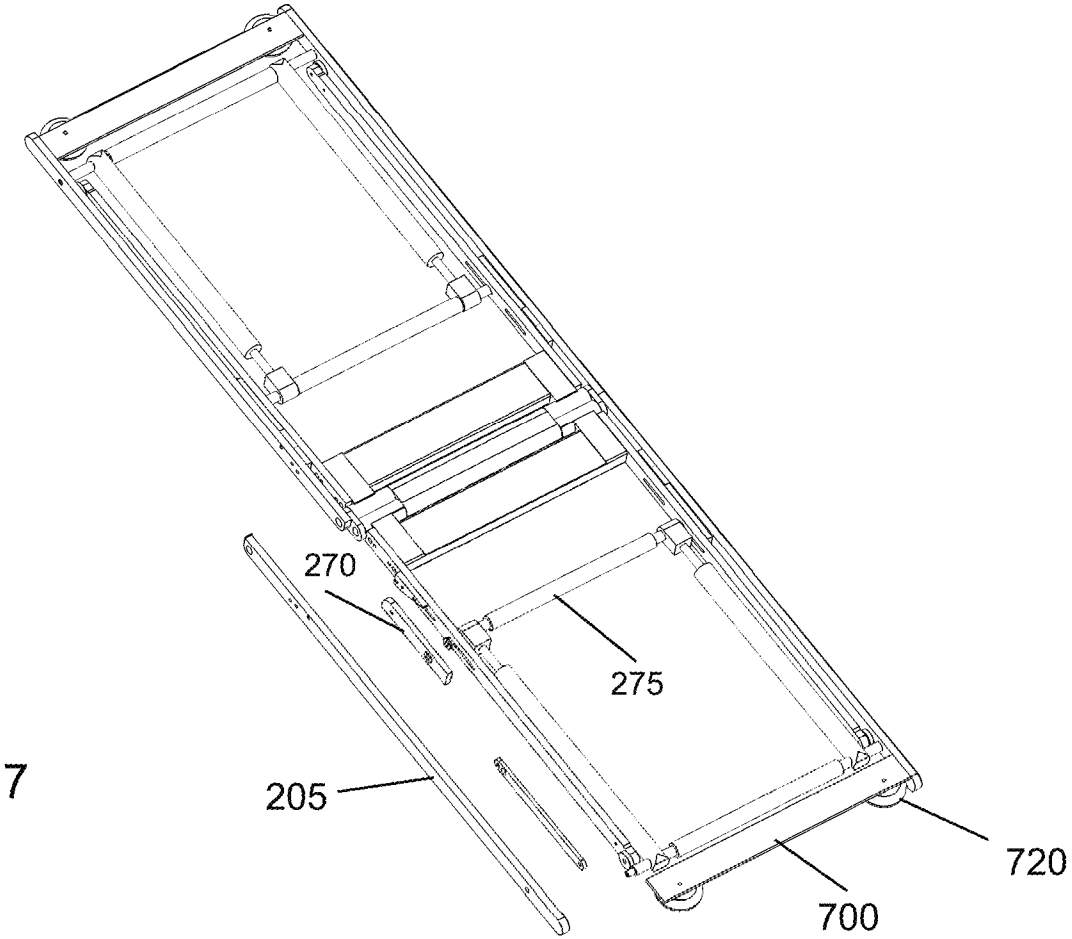
FIG. 27 depicts a perspective view of disclosed components

FIG. 27 depicts various components while the lift is in a flat position. A top bar 205 is shown out of position and a wedge bar 270 is shown as pulled away from a cross bar to help illustrate the cross bar reaching through the wheelie bar to reach the wedge bar. To assist movement of the lift when the lift is in a folded position, a wheel mount 700 may be attached to one or more wheels 720.

Figure 28:
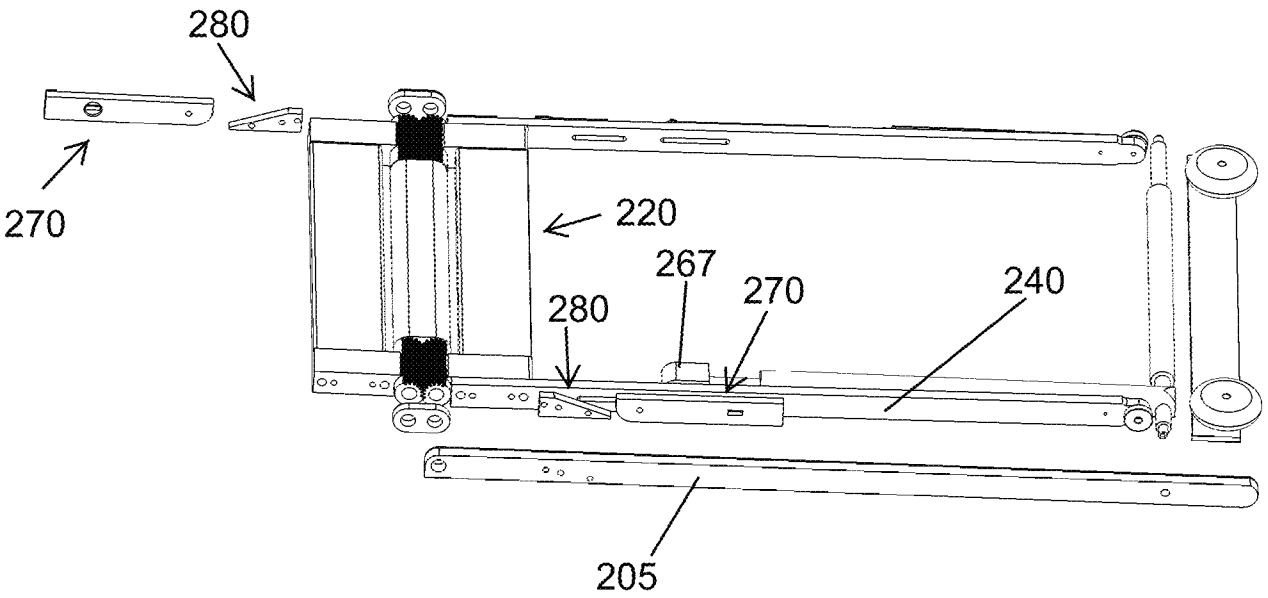
FIG. 28 depicts a perspective view of disclosed components

FIG. 28 depicts various components while the lift is in a flat position. In the foreground, a top bar 205 is shown in a removed position to reveal the relative positions of a wedge bar 270 and a wedge 280. On the right hand side of the drawings, a wheelie bar 240 is shown in connection with the wedge bar and wedge. As the wedge bar is moved into the wedge, the wheelie bar 240 breaks the plane of the top bar 205 allowing the assembly to lift. The wedge bar may be moved by a cylinder rod clevis 267, with the cylinder rod clevis attached to the wedge bar by a pin sliding within a void of the wheelie bar. This artful configuration of components allows for a very flat initial position as most or all of the components are in a flat position. The initial flat position is made possible and is of mechanical advantage, due, in part, to the configuration of the wheelie gear 240, as each wheelie gear meshes by use of gear teeth, as shown more clearly in FIG. 18.

Figure 29:
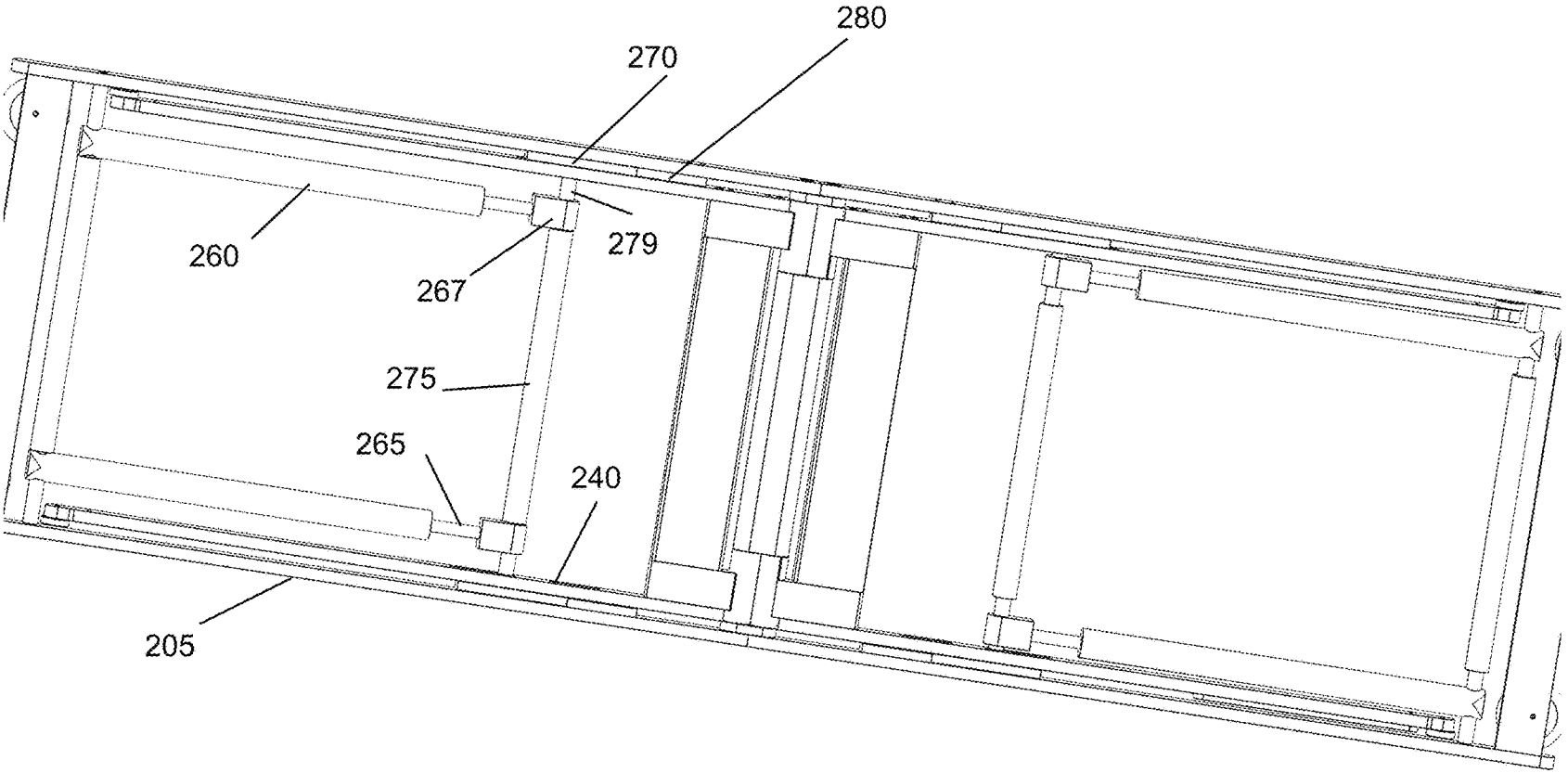
FIG. 29 depicts a perspective view of disclosed components

FIG. 29 depicts a disclosed lift in a flat position with a cylinder 260 being powered to push a piston 265 attached to a cylinder rod clevis 267, with the cylinder rod clevis rotatable attached to a retention area 279 of a cross bar 275. The retention area 279 is part of or attached to a distal insertion area (see 276 of FIG. 16) with the distal insertion area sliding within a wheelie bar and the distal insertion area attached to a wedge bar. As the piston moves out of the cylinder, the wedge bar moves into the wedge, causing the wheelie bar to move the lift upwardly as the gears of the two wheelie gears rotate.

Figure 30:
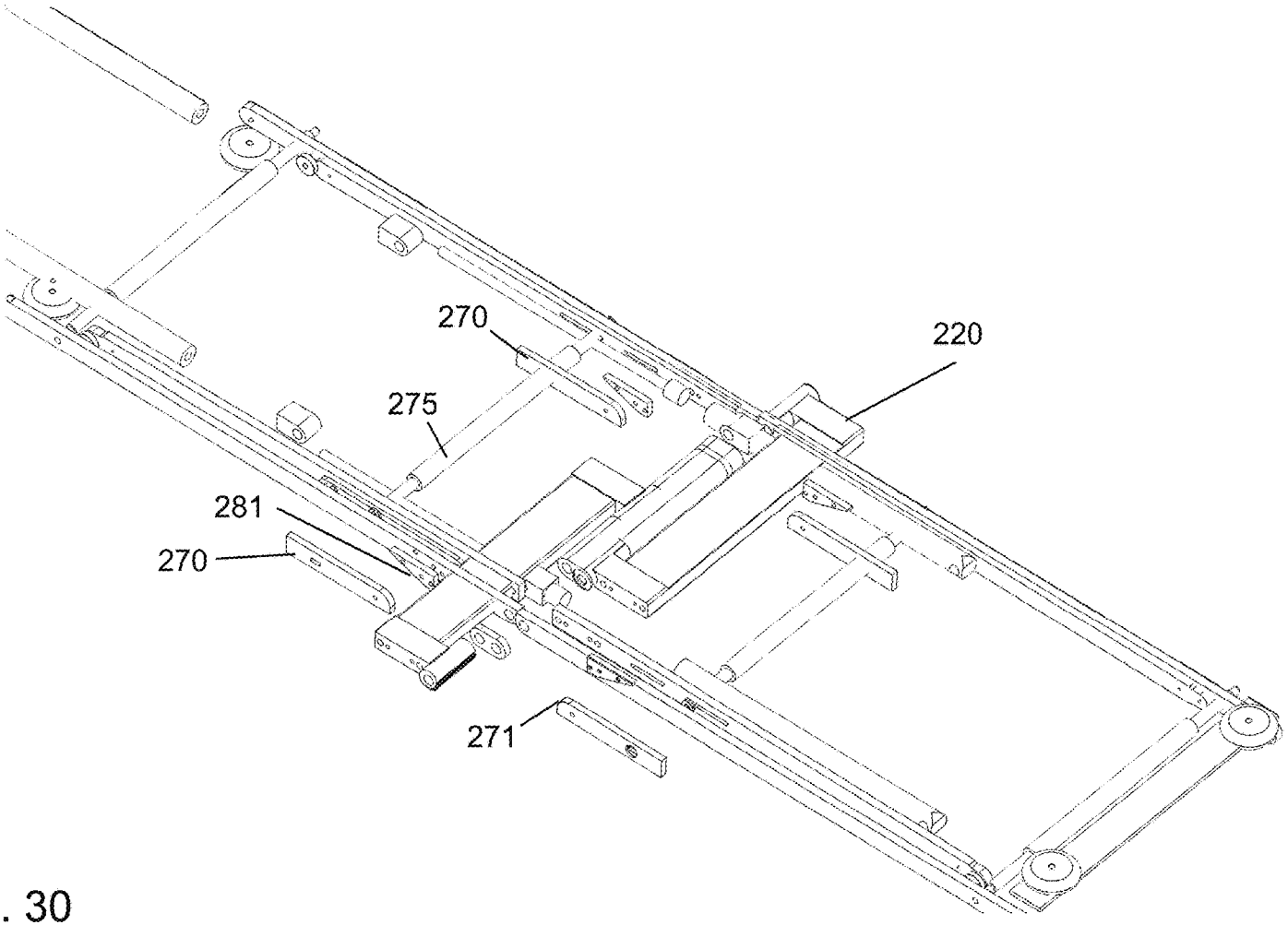
FIG. 30 depicts an exploded view of disclosed components

FIG. 30 depicts various components in an exploded position while the lift is in a flat position. A cross bar 275 is shown in attachment to a wedge bar 270, with the wedge bar shown to be in the center of the lift for illustration purposes only. The retention area (279, FIG. 16) and distal insertion area (276, FIG. 16) provide mechanical advantages in allowing the piston to move the wedge bar through voids in the wheelie bar. This configuration helps to achieve a flat starting position for the lift while providing an efficient movement of the wedge bar into the wedge to start the lifting process.

Figure 31:
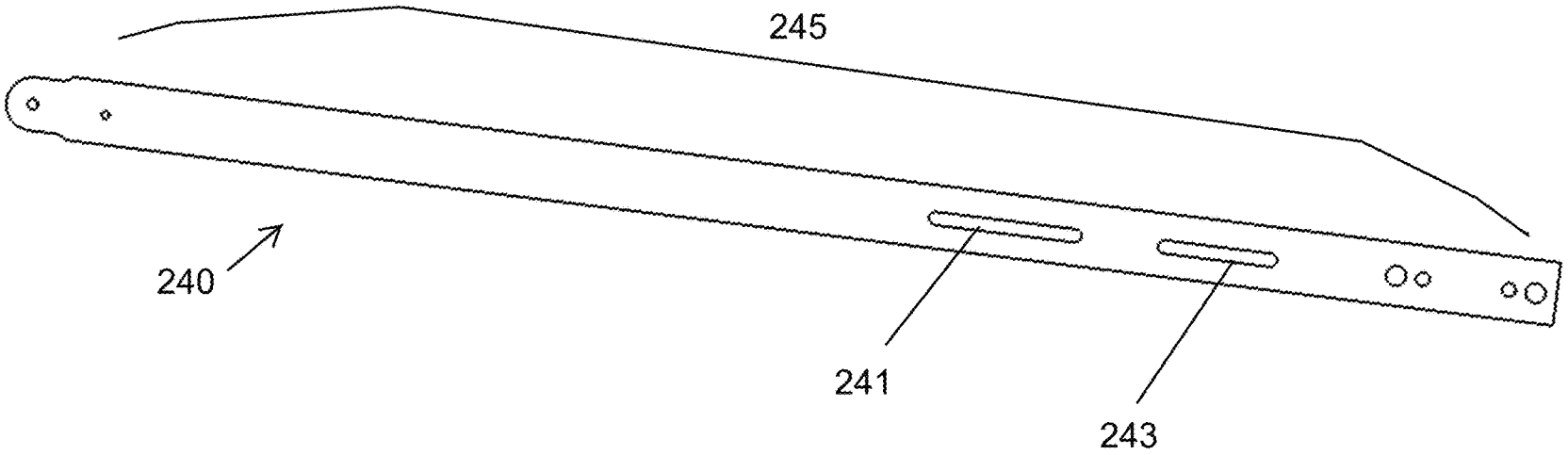
FIG. 31 depicts a plan view of a wheelie bar

FIG. 31 depicts a wheelie bar 240 having a longitudinal body 245. The wheelie bar or longitudinal body of the wheelie bar may define a first longitudinal void 241 and/or a second longitudinal void 243. A longitudinal void 241 may retain or be in slideable connection with a cross bar, with the cross bar moving a wedge bar.

Items

Disclosed embodiments may include the following items.

1. A lift (100) (FIG. 1A) comprising:

a) a first set of two top bars and a second set of two top bars, with each top bar (205) (FIG. 5) attached to a wedge (280) (FIG. 5) and the first set of top bars pivotally attached to a first wheelie gear (220), (FIG. 1A) the first wheelie gear attached to two wheelie bars (240), (FIG. 1A) each wheelie bar comprising a longitudinal body (245) with the longitudinal body defining a first longitudinal void (241) (FIG. 1B) the first longitudinal void of the wheelie bar retaining a lower cross bar (275); (FIG. 7)

b) a wedge bar (270) (FIG. 1B) attached to a distal end of the lower cross bar, the wedge bar comprising a first end having a cambered edge (271) (FIG. 11).

2. The lift of item 1 further comprising a piston attached to the lower cross bar and an upper cross bar (210) (FIG. 7).

3. The lift of item 1 wherein the wedge comprises an angled edge (281), (FIG. 20) the angled edge comporting to the cambered edge of the wedge bar.

4. The lift of item 1 further comprising a cylinder rod clevis 267 (FIG. 7) attached to the lower cross bar and the piston.

5. The lift of item 1 further comprising a cylinder (260) (FIG. 1B) attached to the piston.

6. The lift of item 1 wherein the piston is attached to an upper cross bar (210) (FIG. 7).

7. The lift of item 1 wherein the second set of top bars are pivotally attached to a second wheelie gear and the second wheelie gear is in geared attachment to the first wheelie gear.

8. The lift of item 1 with four pistons.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A lift (100) comprising:

a) a first set of two top bars and a second set of two top bars, with each top bar (205) in fixed attachment to a wedge (280) and the first set of top bars pivotally attached to a first wheelie gear (220), the first wheelie gear attached to two wheelie bars (240), each wheelie bar comprising a longitudinal body (245) with the longitudinal body defining a first longitudinal void (241) the first longitudinal void of the wheelie bar retaining a lower cross bar (275), allowing the lower cross bar to slide within the first longitudinal void of the wheelie bar;

b) a wedge bar (270) attached to a distal end of the lower cross bar, the wedge bar comprising a first end having a cambered edge (271).

2. The lift of claim 1 further comprising at least one piston attached to the lower cross bar and an upper cross bar (210).

3. The lift of claim 2 wherein the wedge comprises an angled edge (281), the angled edge comporting to the cambered edge of the wedge bar.

4. The lift of claim 3 further comprising a cylinder rod clevis (267) attached to the lower cross bar and the piston.

5. The lift of claim 4 further comprising a cylinder (260) attached to the piston.

6. The lift of claim 5 wherein the piston is attached to an upper cross bar (210).

7. The lift of claim 6 wherein the second set of top bars are pivotally attached to a second wheelie gear and the second wheelie gear is in geared attachment to the first wheelie gear.

8. The lift of claim 7 wherein a wheelie bar stiffener (451) is attached to each set of wheelie bars.

9. The lift of claim 8 with four pistons, with each piston attached to a respective lower cross bar and upper cross bar.

* * * * *